US005472075A

United States Patent [19]

Yamashita et al.

[11] Patent Number: 5,472,075

[45] Date of Patent: Dec. 5, 1995

[54] ESCALATOR APPARATUS

[75] Inventors: Masato Yamashita, Osaka; Minako Horie, Nara, both of Japan

[73] Assignee: Fujitec Co., Ltd., Osaka, Japan

[21] Appl. No.: 191,846

[22] Filed: Feb. 4, 1994

[30] Foreign Application Priority Data

Feb. 9, 1993 [JP] Japan ..... 5-045961

[51] Int. Cl.[6] ..... B66B 23/12

[52] U.S. Cl. ..... 198/324; 198/333

[58] Field of Search ..... 198/321, 324, 198/326, 333

[56] References Cited

U.S. PATENT DOCUMENTS

| | | | |
|---|---|---|---|
| 4,557,369 | 12/1985 | Ishida et al. | 198/321 X |
| 4,681,207 | 7/1987 | Goto et al. | 198/333 |
| 5,024,314 | 6/1991 | Kitamura et al. | 198/333 |
| 5,062,519 | 11/1991 | Haruta | 198/333 |
| 5,295,569 | 3/1994 | Kubota | 198/333 |

FOREIGN PATENT DOCUMENTS

| | | | |
|---|---|---|---|
| 56-41555 | 9/1981 | Japan . | |
| 58-2153 | 1/1983 | Japan . | |
| 403249093 | 11/1991 | Japan | 198/324 |
| 404023794 | 1/1992 | Japan | 198/324 |
| 5-39876 | 6/1993 | Japan . | |

*Primary Examiner*—D. Glenn Dayoan
*Attorney, Agent, or Firm*—Jordan and Hamburg

[57] ABSTRACT

The invention provides an escalator constructed such that even persons using large-sized wheelchairs can utilize it with a sense of security together with healthy persons. A group of special steps made of a large-sized step and special steps are disposed between ordinary passenger steps and the special steps are guided by guide rails different from those for the ordinary passenger steps.

11 Claims, 21 Drawing Sheets

BEST AVAILABLE COPY

ESCALATOR APPARATUS

BACKGROUND OF THE INVENTION

The present invention relates to an escalator apparatus which can be safely utilized not only by ordinary passengers but also by special passengers who use vehicles such as wheelchairs, baby carriages and shopping carts.

Conventional escalators have been designed to transport ordinary passengers and hence the depth dimension of the steps is about 400 mm. Therefore, it has been difficult to transport wheelchairs or baby carriages safely while maintaining their horizontal state.

Therefore, various suggestions have been made including:

(1) a first arrangement in which, as in the case of Japanese Patent Publication No. 41555/1981, one or more large-sized steps having a sufficient depth dimension to transport a wheelchair or the like are incorporated in advance and man conveyor start and stop switches for exclusive use by physically handicapped persons are installed, the arrangement being such that operating such stop switch causes the large-sized step to stop at the entrance area and pushing the exclusive start switch subsequent to loading off wheelchair passengers causes the escalator to start, the large-sized step being stopped again at the exit area in the desired story after the lapse of a given time, and (2) a second arrangement in which, as in the case of Japanese Patent Publication No. 2153/1983, all steps are connected by pivotally connecting the main and auxiliary treads to construct an escalator having a substantially great depth dimension capable of carrying vehicles.

In the former escalator apparatus, however, the presence of the large-sized steps, though small in number, each having a sufficient depth dimension to carry a wheelchair or the like thereon, makes it necessary to increase the radii of the sprocket wheels for return drive at the entrance and exit areas, necessarily increasing the size of the escalator and limiting the installation space.

Further, since large-sized steps are combined at random with normal-sized steps, the time at which a large-sized step arrives at an entrance area, or exit area, cannot be known, so when a person using a wheelchair or the like wants to step on the escalator, the large-sized step has to be detected and stopped at the entrance area; thus the traffic will be shut off each time a wheelchair passenger utilizes the escalator.

In the latter escalator apparatus, although there is no need to increase the radii of the sprocket wheels for return drive at the entrance and exit areas, the step height becomes too great for a large-sized step, having a sufficient depth dimension to receive a large-sized wheelchair, at the maximum inclination angle of 30°, as in the conventional escalator. Therefore, there is a danger of a passenger tripping on the step. If the step height is decreased to about 200 mm, approximately the value for the conventional escalator, the maximum inclination angle is decreased to about 10°. To obtain a required lift, the overall length of the escalator is necessarily increased, requiring greater installation space.

Thus, the present applicant has suggested, as described in Japanese Patent Application No. 160448/1988, an escalator apparatus having suitable degrees of step height and inclination angle, without an increase in size, and which is capable of transporting vehicles simultaneously with ordinary passengers.

In the suggested arrangement, a plurality of specific steps, having a predetermined depth, are continuously disposed to form a large-sized step having an increased depth, and a predetermined number of ordinary passenger steps, having a predetermined depth, are continuously disposed between said large-sized steps. The large-sized and ordinary passenger steps form a unit step, such unit steps being endlessly connected. The maximum inclination angle of the escalator can thus be optionally changed by changing the number of ordinary passenger steps.

Such an escalator apparatus is described below with reference to the drawings.

FIG. 2 is a side view showing an example of the lower story of this escalator apparatus; FIG. 3 is a detailed view showing an example of the arrangement of the steps shown in FIG. 2; and FIG. 4 is a diagram for explaining the basic technical concept of this escalator apparatus. In these figures, the numeral 1 denotes an escalator body; 2 denotes a balustrade; 3 and 4 denote steps having risers 3*a* and 4*a* for ordinary passengers; and 10 denotes a large-sized step for conveying a vehicle such as a wheelchair in such a manner that three specific steps 11, 12 and 13, to be later described in more detail, maintain the same horizontal state in the transport region. The large-sized step 10 and the ordinary passenger steps 3 and 4 (only the step 3 or 4 or numbers of setups 3 and 4 may be involved) form a single unit step 100.

The ordinary passenger steps 3 and 4, like conventional steps, have front wheels 31, 41 and rear wheels 32, 42 rotatably mounted in the lower areas of their front and rear ends, so that in the region of maximum inclination, the front wheels 31, 41 and rear wheels 32, 42 are supported and guided by guide rails 33, 43, 34, 44 having a predetermined angle of inclination θ.

The specific step 11 is exactly the same in construction as the ordinary passenger steps 3 and 4, having a riser 11*a*, and front and rear wheels 111 and 112 rotatably mounted in the lower areas of its front and rear ends, so that in the region of maximum inclination, the front and rear wheels 111 and 112 are supported and guided by guide rails 113 and 114 having a predetermined angle of inclination θ.

The specific steps 12 and 13 are the same in construction as the ordinary passenger steps except that they do not have riser portions (they may be ordinary passenger steps having riser portions). The steps 12 and 13 have front wheels 121, 131 and rear wheels 122, 132 rotatably mounted on the lower areas of their front and rear ends, so that in the region of maximum inclination, the front wheels 121, 131 and rear wheels 122, 132 are supported and guided by guide rails 123, 133, 124, 134 having a predetermined angle of inclination θ. The guide rails 133 preferably have a U-shaped cross section to prevent the specific step 13 from deviating upward.

A driving chain 20, for driving the steps, as shown in FIG. 3, is attached to the shafts 31*a*, 41*a* of the front wheels 31, 41 of the ordinary passenger steps 3, 4 and the shafts 111*a*, 121*a*, 131*a* of the front wheels 111, 121, 131 of the specific steps 11, 12 and 13. The driving chain 20 is in endless form.

The riser of a step of the escalator, as shown in FIG. 5, has a curve having a radius R with the center located at the front end A5 of the tread 5 of the step, that is, a curve having the depth dimension L of the tread 5. Thus, the maximum angle of inclination θ of an escalator having large-sized steps and ordinary steps regularly combined therewith to form unit steps 100 as shown in FIG. 3 is expressed by the formula 1 below.

$$\theta = \tan^{-1} \frac{H(n+1)}{L(N-1) + L(n+1)\cos\theta_1} \quad (1)$$

where, as in FIG. 4, n is the number of ordinary passenger steps included in each unit step; H is the common step height; L is the depth dimension of ordinary passenger steps; $\theta_1$ is the angle of inclination of ordinary passenger steps; and N is the magnification of the depth dimension of the large-sized steps with respect to ordinary passenger steps.

In FIG. 3, if the depth dimension L of the ordinary passenger steps 3 and 4 is 400 mm, the step height H is 200 mm, the magnification N of the depth dimension of the large-sized steps 10 is 3, and the angle of inclination $\theta_1$ of the ordinary passenger steps 3 and 4 is 30°, then the maximum angle of inclination θ of the escalator in FIG. 3 is expressed by the formula 2, which is a function of the number n of ordinary steps 3 and 4 included in each unit step 100, it being seen that as the number n increases, a greater value of θ in the formula 2 can be taken (it being noted that $\theta_1$ is not more that 30°). For example, for n=2, θ=18°, for n=3, θ=20°, for n=4, θ=22° . . . for n=22, θ=28°.

$$\theta = \tan^{-1} \frac{200(n+1)}{400(3-1) + 400(n+1)\cos 30°} \quad (2)$$

Therefore, the arrangement shown in FIG. 3 provides an escalator which is theoretically short in overall length since in order to obtain a rise required by the escalator, the maximum angle of inclination can be made as great as possible without increasing the step height irrespective of the presence of large-sized steps on which wheelchairs and the like can be carried.

In this connection, in the arrangement of FIG. 3, the number of guide rails for guiding the front and rear wheels of steps increases, but to prevent it, arrangements shown in FIGS. 6 and 7 may be employed.

First, in FIG. 6 in which the parts having the same reference characters as in FIG. 3 indicate the same parts, the numeral 50 denotes a large-sized step connected as by hinges 54 and 55 so that it can be bent backward at the opposed end surface of specific steps 51, 52 and 53 while being prevented from bending forward so that it is held in the same horizontal plane in the transport region. The large-sized step 50 cooperates with the ordinary passenger steps 3 and 4 (in this case also, only the step 3 or 4 or numbers of steps 3 and 4 may be involved) to form a single unit step 200 as in the case of FIG. 3.

The specific step 51 has a riser 51*a* like those of the ordinary passenger steps 3 and 4 and has a rear wheel 512 rotatably mounted in the rear lower area (with no front wheel at the front end). Each rear wheel 512 being supported and guided by a guide rail 514 having a predetermined angle of inclination θ in the region of maximum inclination of the escalator.

The specific step 52 has only a tread 52*b* and the specific step 53 has no riser but a front wheel 531 rotatably mounted in the front lower area (with no rear wheel at the rear end). Each front wheel 531 is supported and guided by a guide rail 533 having a U-shaped cross section with a predetermined angle of inclination θ in the region of maximum inclination of the escalator.

Therefore, in the arrangement shown in FIG. 6, the number of rails is 4 less on either side than that of guide rails used in the arrangement shown in FIG. 3. A driving chain 21, for driving the steps, is attached to the shafts 31*a* and 41*a* of the front wheels 31 and 41 of the ordinary passenger steps 3 and 4 and the shaft 531*a* of the front wheel 531 of the specific step 53. The driving chain 21 is connected in endless form. In addition, the riser 51*a* of the specific step 51 differs from the riser 11*a* of the specific step 11 shown in FIG. 3 in the following points.

The ordinary passenger step 3, opposed to the riser 51*a* of the specific step 51 shown in FIG. 6, is designed to rise and lower in its horizontal state while maintaining unchanged the distance $R_1$ between the shaft 531*a* of the front wheel 531 of the specific step 53 and the shaft 31*a* of the front wheel 31 of the ordinary passenger step 3. This design makes it necessary to arrange the riser 51*a* of the specific step 51 such that it has a curved surface with a radius equal to the distance $R_1$.

In contrast, in the case of the specific step 11 of FIG. 3, the riser 11*a* of this specific step 11 has a curved surface with its radius equal to the distance R between the shaft 111*a* of the front wheel 111 of the specific step 11 and the shaft 31*a* of the front wheel 31 of the ordinary passenger step 3, that is, the same curved surface as those of the risers 3*a* and 4*a* of the ordinary passenger steps 3 and 4.

In the unit step 200 in FIG. 6, if the front end A3 and front wheel shaft 31*a* of the ordinary passenger step 3 and the front end 53A and front wheel shaft 531*a* of the specific step 53 are arranged to form a parallelogram, then the riser 51*a* of the specific step 51 has to be formed with a curved surface having a radius equal to the depth dimension $R_2$ of the large-sized step 50 with the center located at the front end A53 of the specific step 53. Usually the dimension $R_1$ equals this dimension $R_2$.

An embodiment which makes it possible to further reduce the number of rails by two more on each side will now be described with reference to FIG. 7. In FIG. 7, the numeral 60 denotes a large-sized step connected as by hinges 64 and 65 so that it can be bent backward at the opposed end surfaces of the specific steps 61, 62 and 63. In the transport region of operation, these steps are maintained in the same horizontal plane. The numeral 612 denotes a rear wheel rotatably mounted in the lower area of the rear end of the specific step 61 having a riser 61*a*. The rear wheel 612 is supported and guided by a guide rail 614 having a predetermined angle of inclination θ in the region of maximum inclination of the escalator.

The numeral 631 denotes a front wheel rotatably mounted in the lower area of the front end of the specific step 63 through a shaft 631*a*. The front wheel 613 is supported and guided by a guide rail 633 having a predetermined angle of inclination θ in the region of maximum inclination of the escalator.

The numeral 66 denotes a support link rotatably connected to the lower areas of the front ends of the specific steps 61 and 62 by pins 66*a* and 66*b* and also to the front wheel shaft 631*a* of the specific step 63, with means, e.g., hinges 66*c* and 66*d*, disposed between the pins 66*a* and 66*b* and between the pin 66*b* and the shaft 631*a* to allow said link to be bent only toward the tread side of said large-sized step 60.

The numerals 7 and 8 denote ordinary passenger steps having risers 7*a* and 8*a*, and 72 denotes a rear wheel rotatably mounted in the lower area of the rear end of the ordinary passenger step 7. The rear wheel 72 is supported and guided by a guide rail 74 having a predetermined angle of inclination θ in the region of maximum inclination of the escalator. The numeral 82 denotes a rear wheel rotatably mounted in the lower area of the rear end of the ordinary passenger step 8. The rear wheel 82 being supported and guided by a guide rail 84 having a predetermined angle of inclination θ in the region of maximum inclination of the escalator.

The numeral 67 denotes a support link connected to the lower areas of the front ends of the ordinary passenger steps 7 and 8 by pins 67*a* and 67*b*, the lower area of the front end of the specific step 61 above the ordinary passenger step 7, and to the support link 66 by pin 66*a*. Support link 67 is slidably connected to the shaft 631'*a* of the front wheel 631' of the specific step 63' constituting a large-sized step below the ordinary passenger step 8 through an elongated opening 67*c*. The link elements being connected by means, e.g., hinges 67*d*, 67*e* and 67*f* disposed between the pins 67*a* and 67*b*, between the pins 67*a* and 66*a* and between pins 67*b* and shaft 631'*a* allow the link elements to be bent only toward the tread side.

The large-sized step 60 cooperates with the ordinary passenger steps 7 and 8 (only the ordinary step 7 or 8 or numbers of ordinary passenger steps 7 and 8 may be involved) to form a unit step 300. A driving chain 22 for driving said unit 300 is attached only to the shafts 631*a* and 631'*a* of the front wheels 631 and 631' of the specific steps 63 and 63'. The driving chain is in endless form.

Now, let the depth dimensions of the treads of the specific steps 61, 62, 63 and 63' and ordinary passenger steps 7 and 8 be the same as L and let the distance between the pins 66*a* and 66*b* of the support link 66, the distance between the pin 66*b* of the support link 66 and the shaft 631*a*, the distance between the pins 67*a* and 67*b* of the support link 67, and the distance between the pins 66*a* and 67*a* of the support link 67 be also the same as L. Let the front end A7 and pin 67*a* of the ordinary passenger step 7 and the front end A61 and pin 66*a* of the specific step 61 define a parallelogram, the front end A8 and pin 67*b* of the ordinary passenger step 8 and the front end A7 and pin 67*a* of the ordinary passenger step 7 define a parallelogram and the front end A63' and shaft 631'*a* of the specific step 63' and the front end A8 and pin 67*b* of the ordinary passenger step 8 define a parallelogram. Then it follows that the ordinary passenger steps 7 and 8 describe arcs having a radius L with the respective centers located at the pins 66*a* and 67*a* of the support link 67 with respect to the respective upper steps. Therefore, the riser 61*a* of the specific step 61 and the riser 7*a* of the ordinary passenger step 7 have curved surfaces having a radius L with their respective centers located at the front ends A61 and A7.

As to the specific step 63', however, since it moves in such a manner as to maintain a fixed distance between the shaft 631*a* of the specific step 63 thereabove and the shaft 631'*a* of the specific step 63' therebelow, the distance between the pin 67*b* of the ordinary passenger step 8 and the shaft 631'*a* of the specific step 63' equals the depth dimension L of the step in the horizontal travel region for the escalator and in the region having a predetermined angle of inclination it gradually increases beyond L as the shaft 631'*a* slides in the elongated opening 67*c* of the support link 67. Thus, the curved surface of the riser 8*a* of the ordinary passenger step 8 has to be formed such that its radius with the center located at the front end A8 gradually changes.

In the escalator of such construction, only the specific steps 63 and 63' of the unit step 300 are directly driven by the drive chain 22, while the specific steps 61 and 62 are driven through the support link 66 and the ordinary passenger step is driven through the support links 66 and 67, driving the unit step 300 in its entirety.

The support link 66 serves to increase the rigidity of the large-sized step 60 and the support link 67 serves to maintain the horizontal state of the ordinary passenger steps 7 and 8. At the reversal points for the steps in the top and bottom regions of an escalator, they are bent at the hinges 66*c*, 66*d* and 67*d*, 67*e*, 67*f*, so that there is no possibility of the links interfering with the movement of the escalator when the drive chain 22 is driven.

In such escalators, there have been shown regular combinations comprising a large-sized step with a depth dimension greater than that of ordinary passenger steps and ordinary passenger steps having a predetermined depth dimension forming a unit step. The three embodiments described above show examples in which three specific steps are used to form a large-sized step to support a large-sized wheelchair, such as a motor-powered wheelchair. However, there are other cases in which two specific steps are sufficient to provide a sufficiently wide space for a baby carriage, a shopping cart, a child's wheelchair or the like. Such unit steps are connected in endless form; thus, any desired maximum angle of inclination of the escalator can be easily selected, without changing the step height, by simply changing the number of ordinary passenger steps to be connected.

In such escalator apparatus, various means have been made to decrease the number of guide rails. Each of the examples shown in FIGS. 3, 6 and 7 increases the number of guide rails to one degree or another if the number of ordinary passenger steps included in the unit step is increased. Even if the number of ordinary passenger steps is increased to make the maximum angle of inclination of the escalator to approach 30° so as to decrease the overall length of the escalator, the number of guide rails which guide the steps increases in proportion thereto, resulting in a new problem that the width of the escalator has to be increased. Further, an increase in the number of guide rails leads to an increase in the weight of the trusses supporting the rails; thus, the problem is not limited to one of installation space.

The present invention has been accomplished with the above in mind and has for its object the provision of a vehicle transporting, space-saving escalator apparatus which minimizes the number of rails which guide the steps while providing a suitable degree of maximum angle of inclination.

SUMMARY OF THE INVENTION

According to the present invention, an escalator includes a plurality of adjacent steps to form a large-sized step having a greater depth than that of ordinary passenger steps. The large-sized step is guided with its horizontal state maintained in the horizontal, transient and inclined regions of the escalator. The escalator includes a plurality of special steps which are guided by first and second guide rails in the horizontal and inclined regions, respectively. The first and second rails are different from each other. The special steps are disposed to form part of the large-sized step and continue to the lower part of the large-sized step.

With the arrangement described above, since the large-sized step is periodically circulated, a vehicle as a wheelchair can smoothly step on and off while the escalator is running.

According to the present invention, since the number of guide rails for guiding the steps can be reduced to a necessary minimum, a space-saving escalator can be obtained in which the width of the escalator is the same as in the conventional escalator and the angle of inclination of the escalator is approximate to the maximum inclination angle of the conventional escalator.

Further, the reduced number of guide rails required eliminates the problem of beam strength for the building structure which would be otherwise caused by the increased weight of the entire truss.

BRIEF DESCRIPTION OF THE DRAWINGS

FIG. 12(*b*) shows an enlarged side view of the special step of FIG. 12(*a*).

DESCRIPTION OF THE PREFERRED EMBODIMENTS

Figure 1:
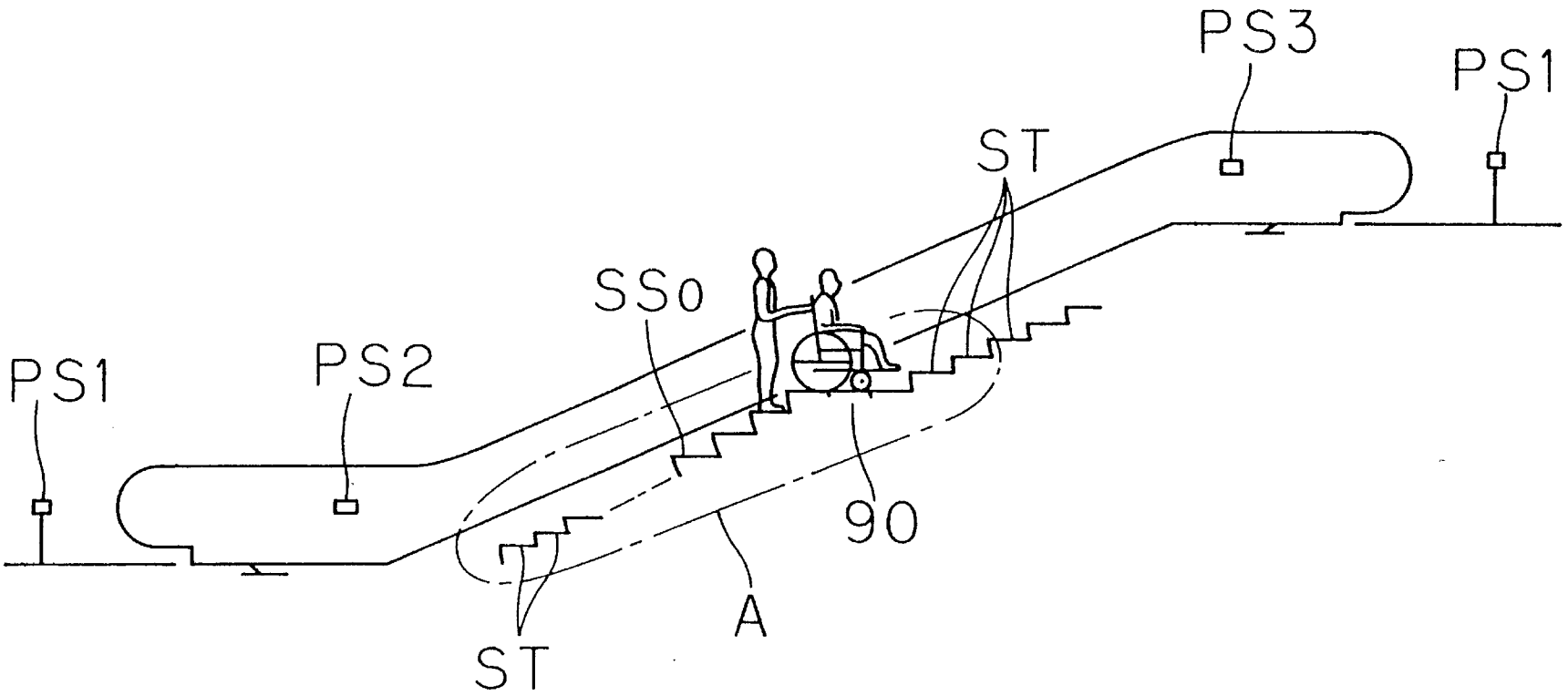
FIG. 1 is a schematic view showing the overall arrangement of an escalator according to the present invention.
Figure 2:
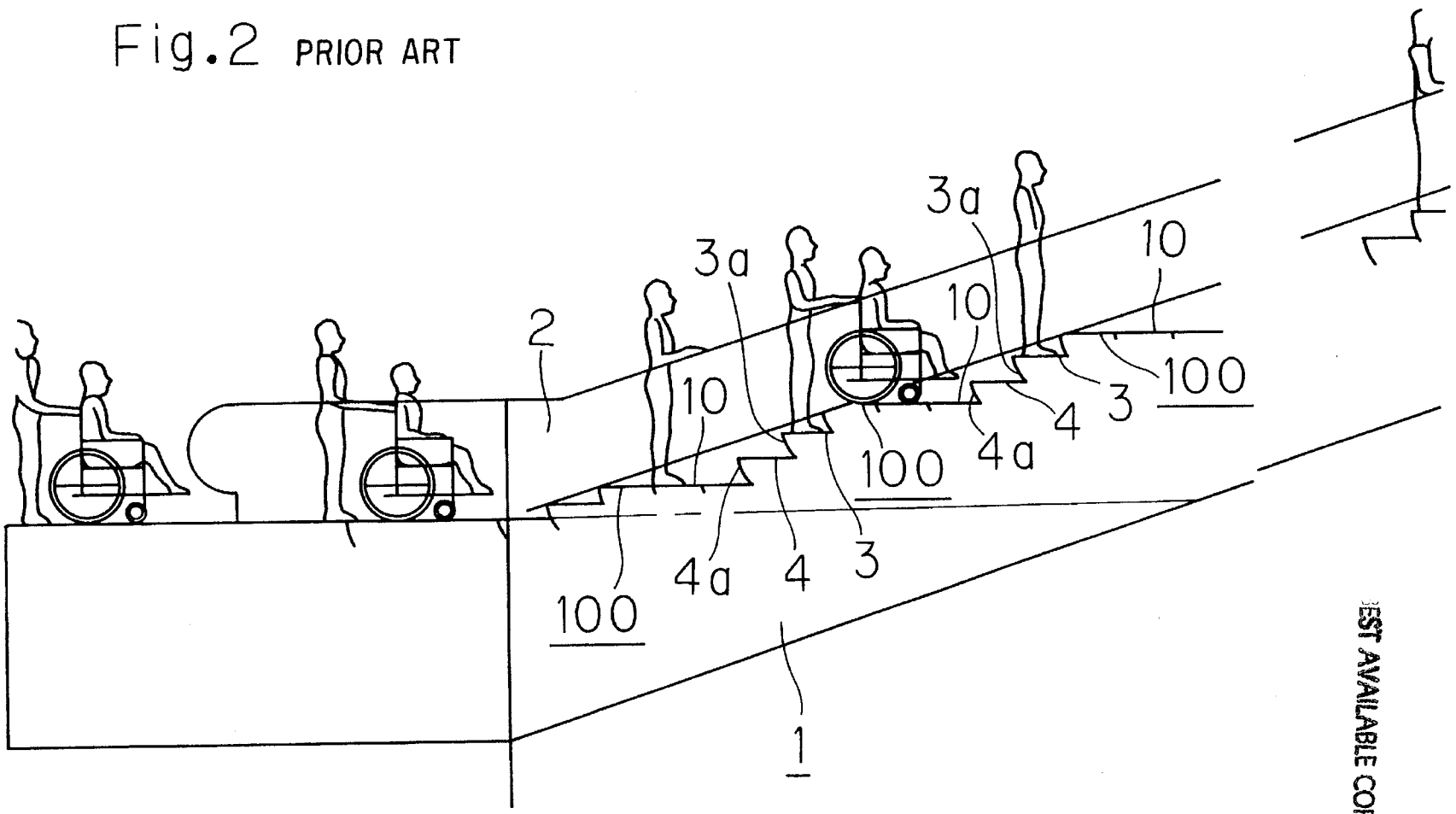
Fig. 2 PRIOR ART
FIG. 2 is a side view showing an example of the lower story of a tiltable escalator.
Figure 3:
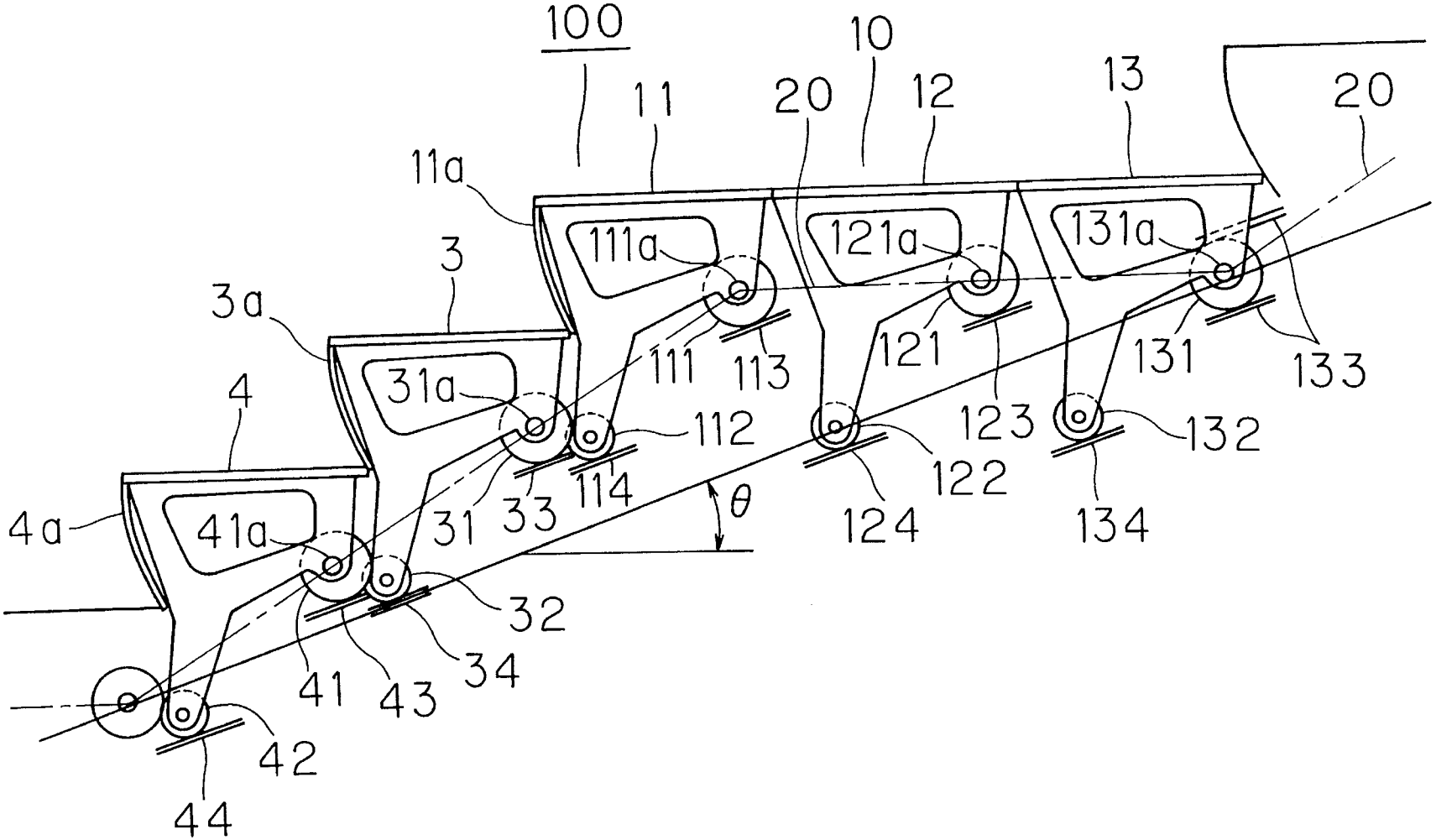
Fig. 3 PRIOR ART
FIG. 3 is a detailed view showing an example of the arrangement of the steps of the tiltable escalator shown in FIG. 2.
Figure 4:
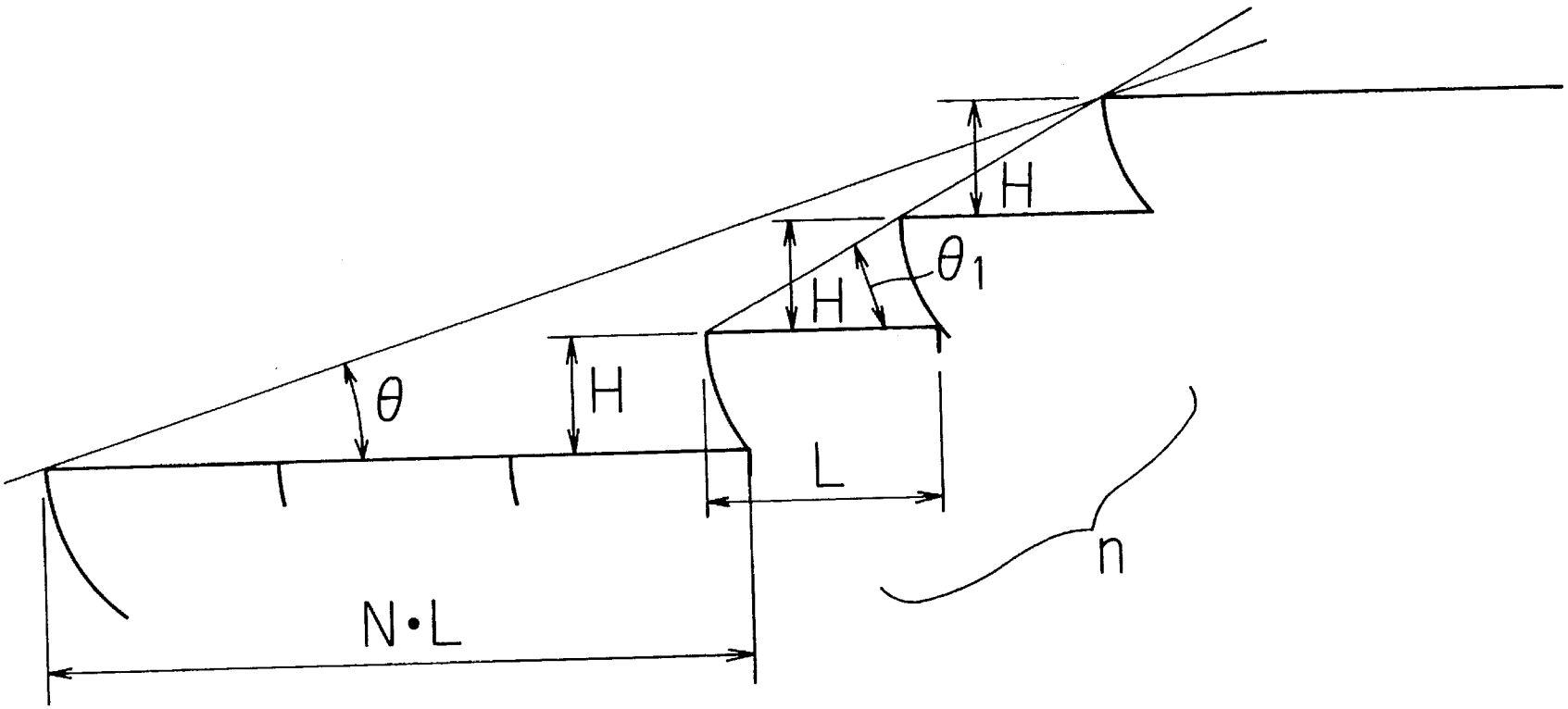
Fig.4 PRIOR ART
FIG. 4 is an explanatory view for explaining the basic technical concept of the tiltable escalator.
Figure 5:
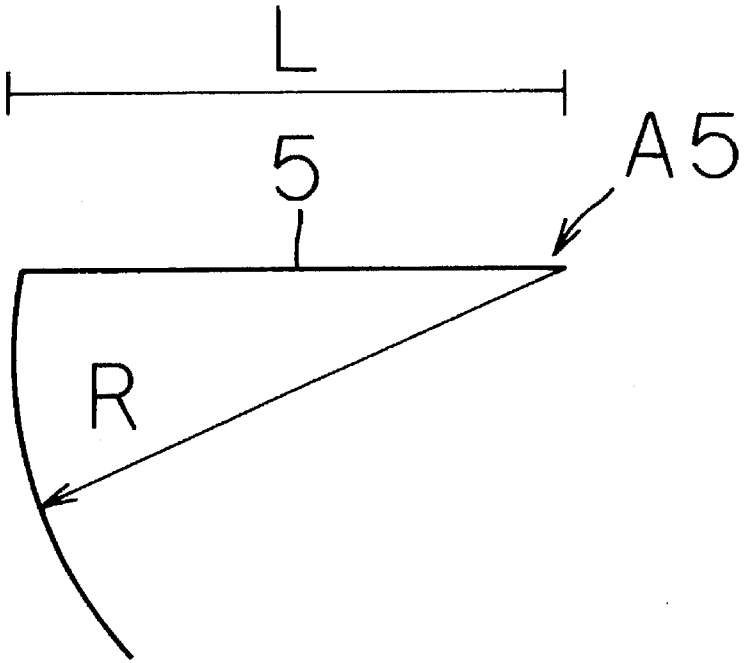
Fig. 5 PRIOR ART
FIG. 5 is a view showing the shape of an ordinary step riser.
Figure 6:
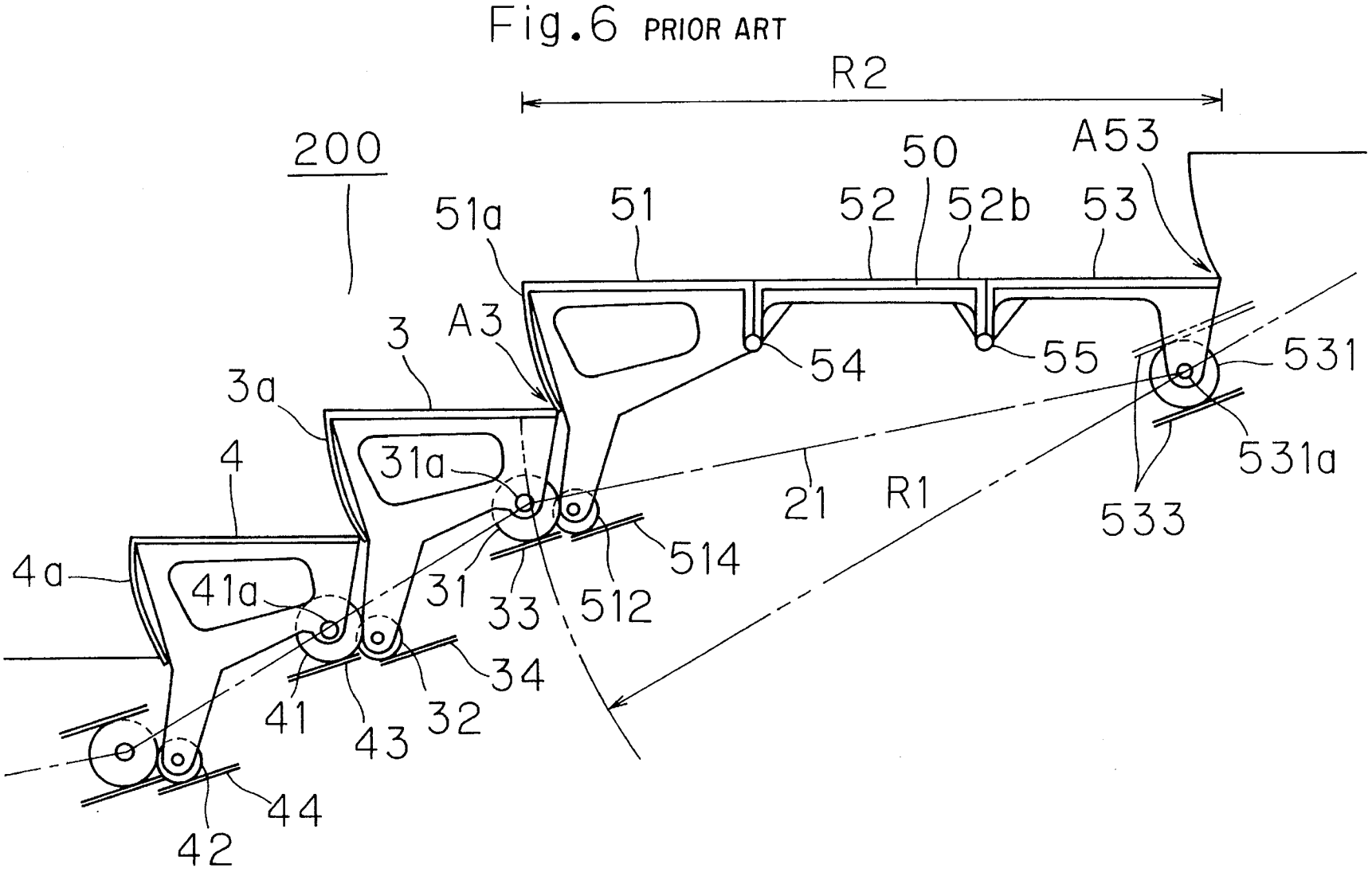
Fig.6 PRIOR ART
FIG. 6 is a detailed view showing another example of the arrangement of the steps of the tiltable escalator shown in FIG. 2.
Figure 7:
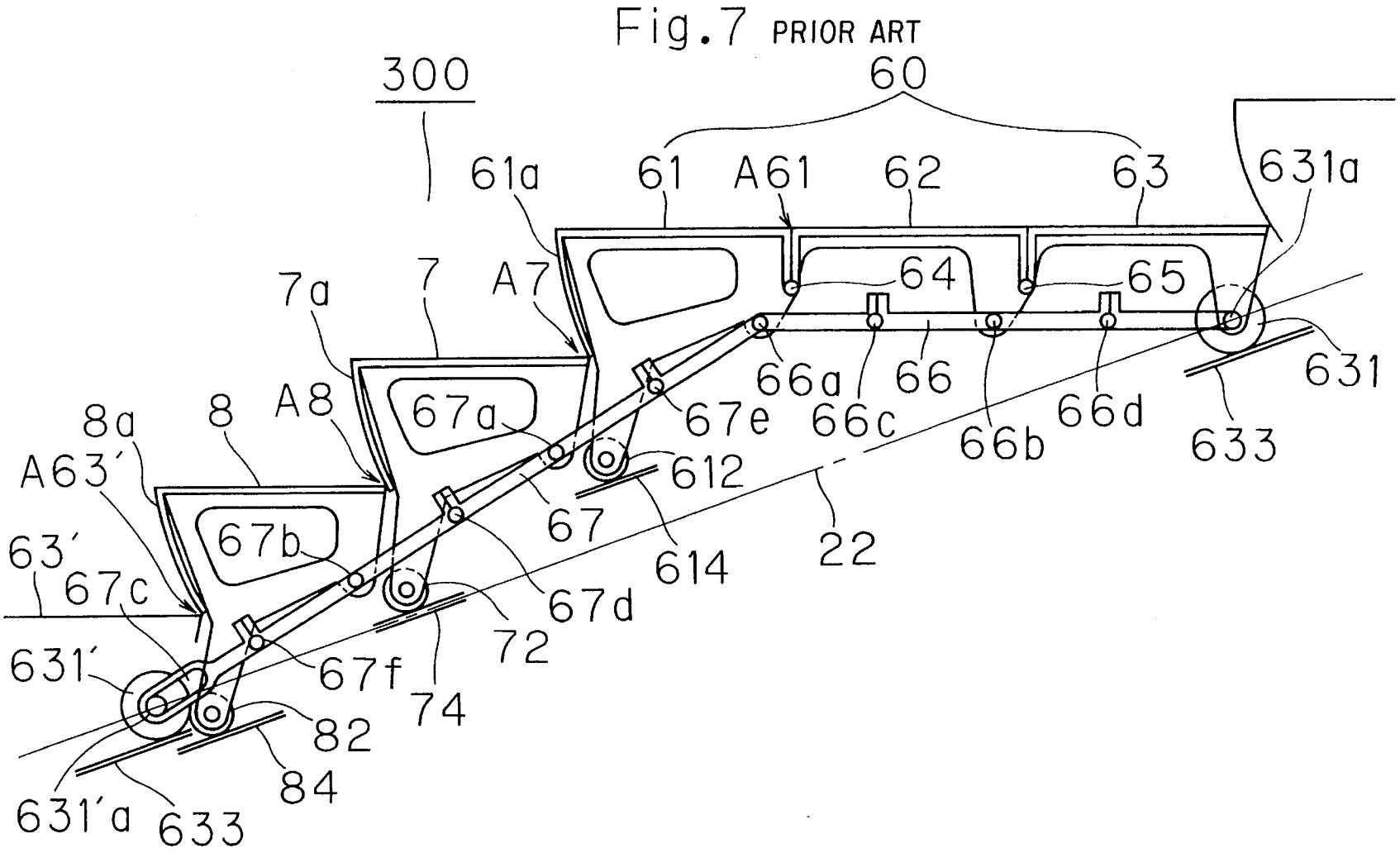
Fig. 7 PRIOR ART
FIG. 7 is a detailed view showing another example of the arrangement of the steps of the tiltable escalator shown in FIG. 2.
Figure 8:
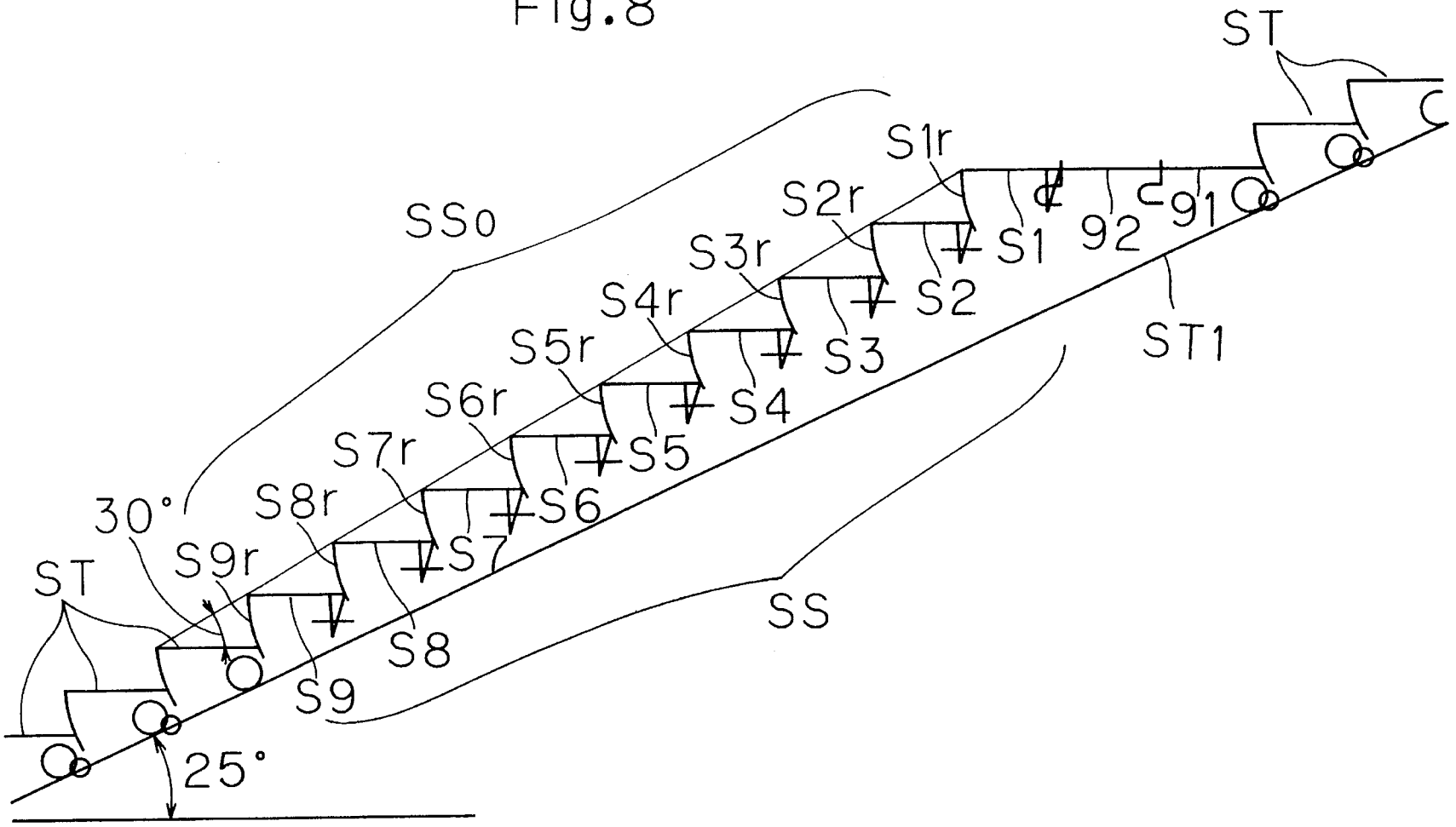
FIG. 8 is an enlarged view of an area A in FIG. 1.
Figure 9:
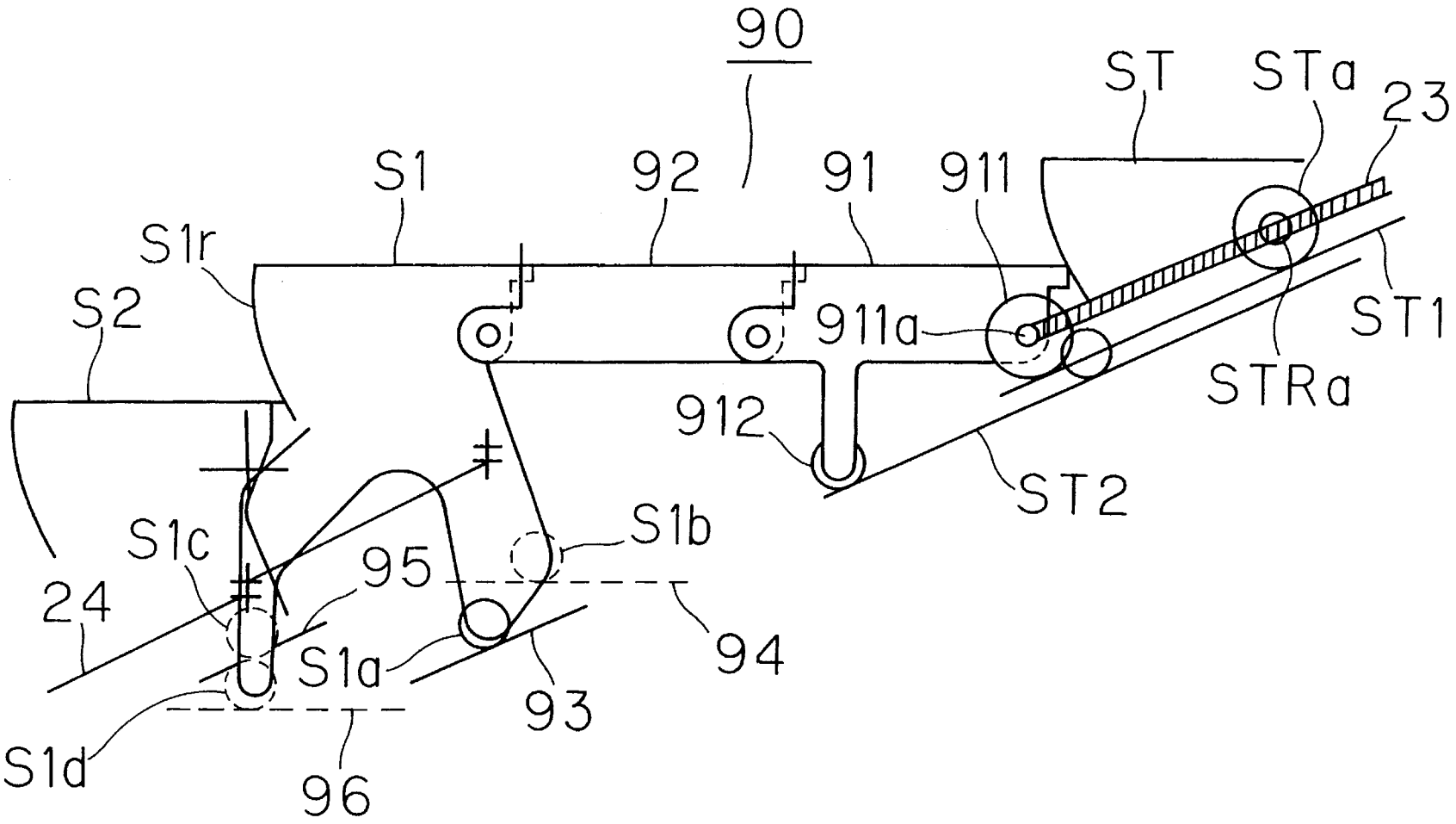
FIG. 9 is an enlarged view of a large-sized step 90 in FIG. 8.
Figure 10:
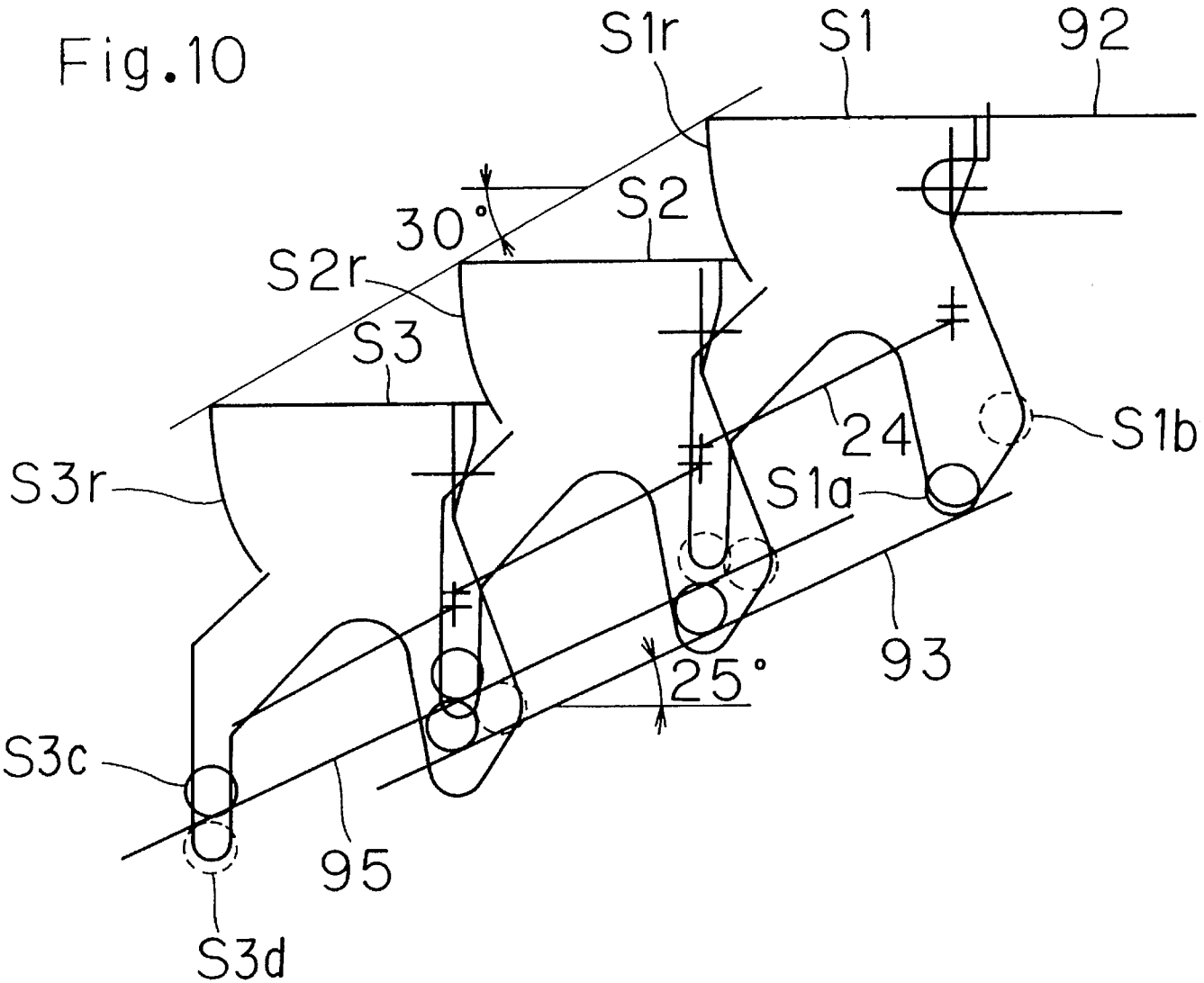
FIG. 10 is an enlarged view of special steps for ordinary passengers in FIG. 8.
Figure 11:
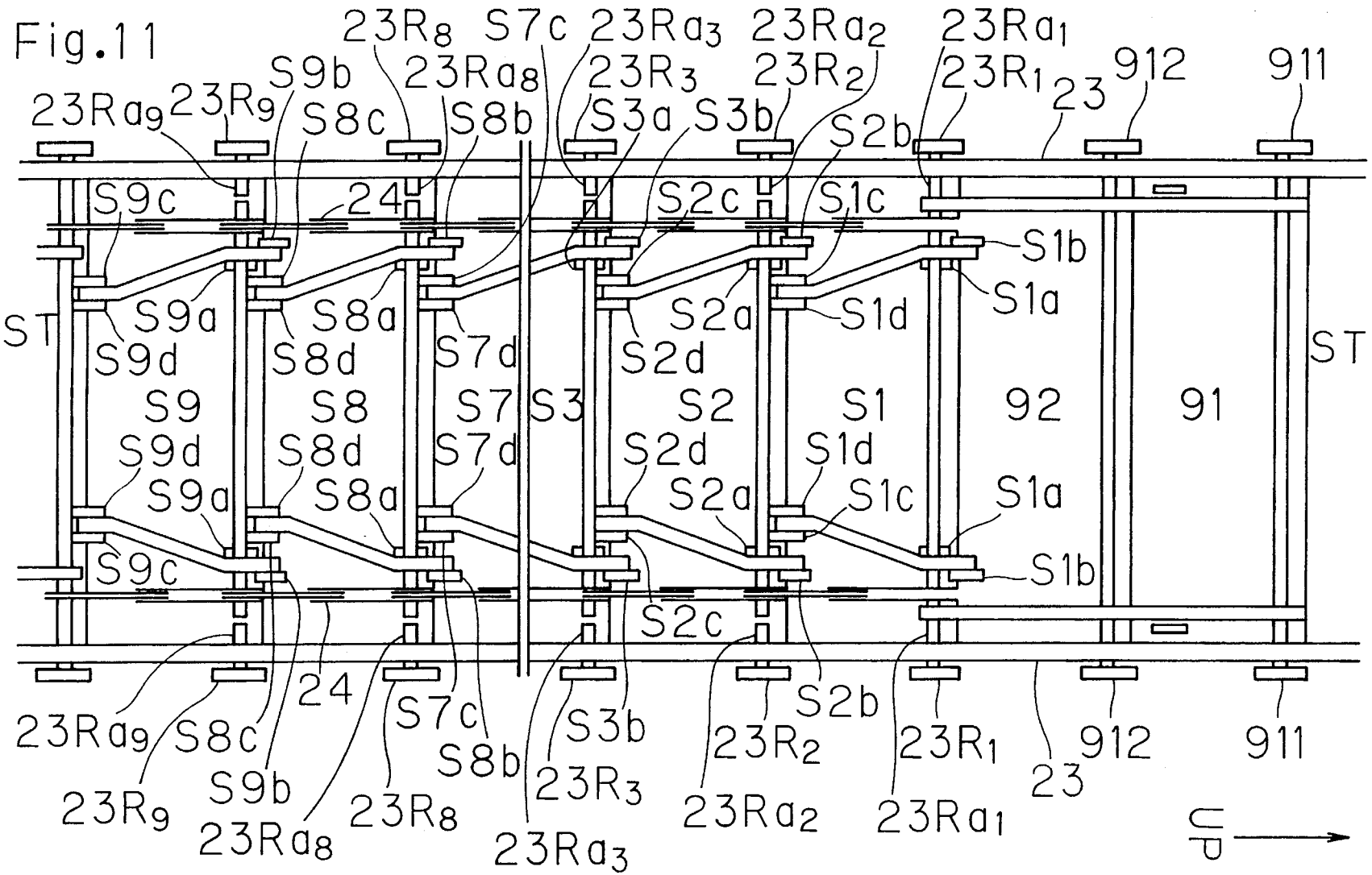
FIG. 11 is a plan view of FIG. 8.
Figure 12A:
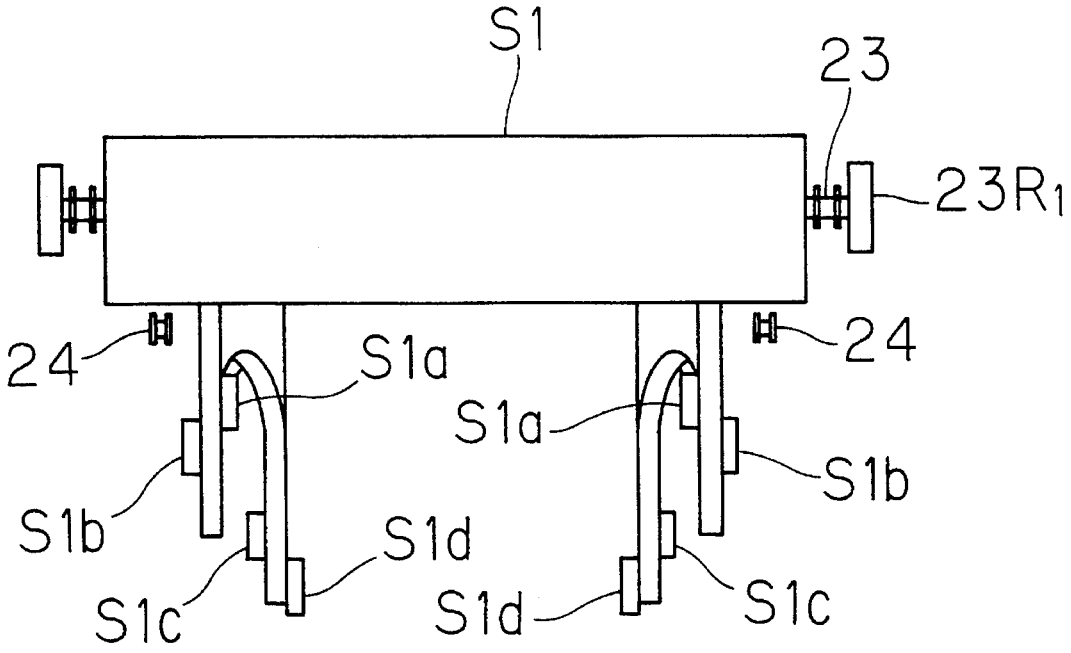
FIG. 12(*a*) is a an enlarged front view of a special step for ordinary passengers in FIG. 8.
Figure 12B:
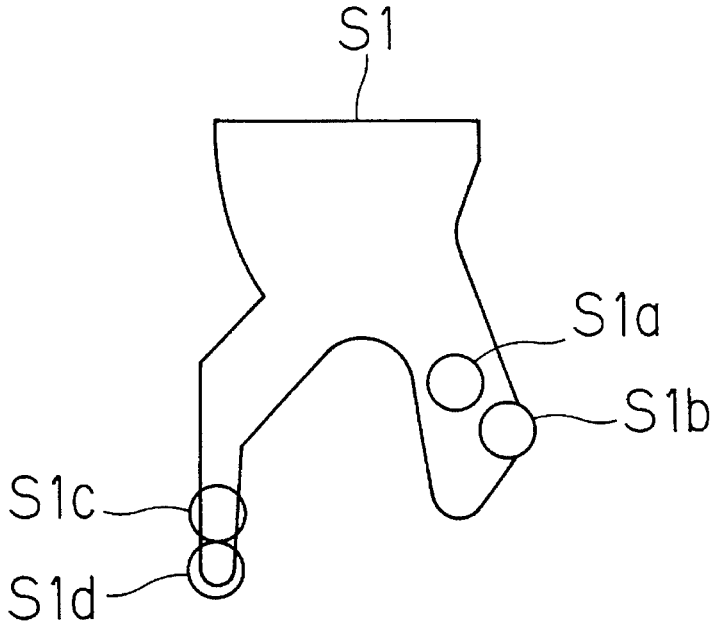

Referring to FIGS. 1 and 8–12, the same reference characters as used in FIGS. 2 through 7 denote the same parts, and the numeral 90 denotes a large-sized step according to the present invention. The large-sized step 90 comprises two specific steps 91 and 92 and one special step S1 which are rotatably connected together so they travel always in the same horizontal state in a transport region.

The specific step 91, like an ordinary passenger step ST, is a step which has front and rear wheels 911 and 912 rotatably mounted thereon, supported and guided by guide rails $ST_1$ and $ST_2$ having a predetermined angle of inclination θ, but which need not have a riser portion. The specific step 92 is a step which requires neither front and rear wheels nor a riser portion; it is only necessary for it to have a tread.

Figure 13:
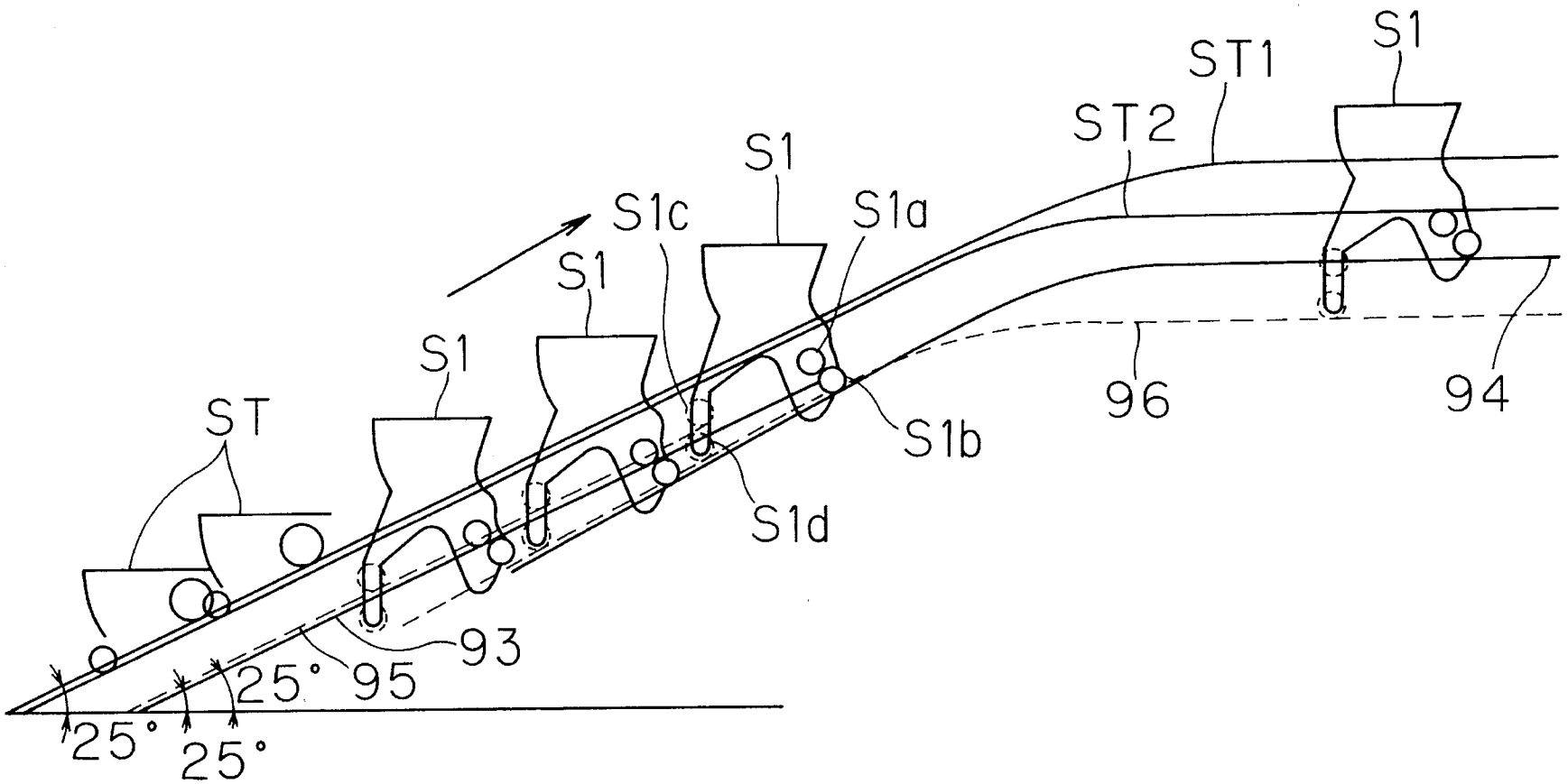
FIG. 13 is a view showing the path of travel of special steps for ordinary passengers.

The special step S1 has two types of front wheels S1*a* and S1*b*, two types of rear wheels S1*c* and S1*d* rotatably mounted thereon, and a riser S1*r* having a curved surface different from the conventional one. The front wheel S1*a*, as shown in FIG. 13, is supported and guided by a guide rail 93 installed inside the escalator body 1 at a predetermined angle of inclination, for example, about 25°. The front wheel S1*b* is supported and guided by a guide rail 94 installed inside the escalator body 1 to extend from the transient portion of the escalator to the horizontal portion. In the inclined portion, the front wheel S1*b* is supported and guided by the guide rail 93 (the front wheel S1*b* is separated from the guide rail 94). From the transient portion the front wheel S1*b* is supported and guided by the guide rail 94 and in the horizontal portion the front wheel S1*a* is completely separated from the guide rail 93.

The rear wheel S1*c*, as shown in FIG. 13, is supported and guided by a guide rail 95 installed inside the escalator body 1 at a predetermined angle of inclination, for example, about 25°. The rear wheel S1*d* is supported and guided by the guide rail 96 installed inside the escalator body 1 to extend from the transient portion of the escalator to the horizontal portion. In the inclined portion, the rear wheel S1*c* is supported and guided by the guide rail 95 (the rear wheel S1*d* is separated from the guide rail 96). In the transient portion, the rear wheel S1*d* is supported and guided by the guide rail 96 and in the horizontal portion the rear wheel S1*c* is completely separated from the guide rail 95.

Therefore, the special step S1 travels together with the specific steps 91, 92, the front wheels S1*a*, S1*b* and the rear wheels S1*c*, S1*d* being guided by the guide rails 93, 95 and 94, 96 and $ST_1$, $ST_2$.

S2 through S9 are special steps for ordinary passengers, constructed in substantially the same manner as the special step S1, having front wheels S2*a*, S2*b* through S9*a*, S9*b*, rear wheels S2*c*, S2*d* through S9*c*, S9*d* and risers S2*r* through S9*r*. However, in the inclined portion, the front wheels S2*a* through S9*a* and rear wheels S2*c* through S9*c*, guided by the guide rails 93 and 95, are vertically slightly displaced from each other.

Figure 14:
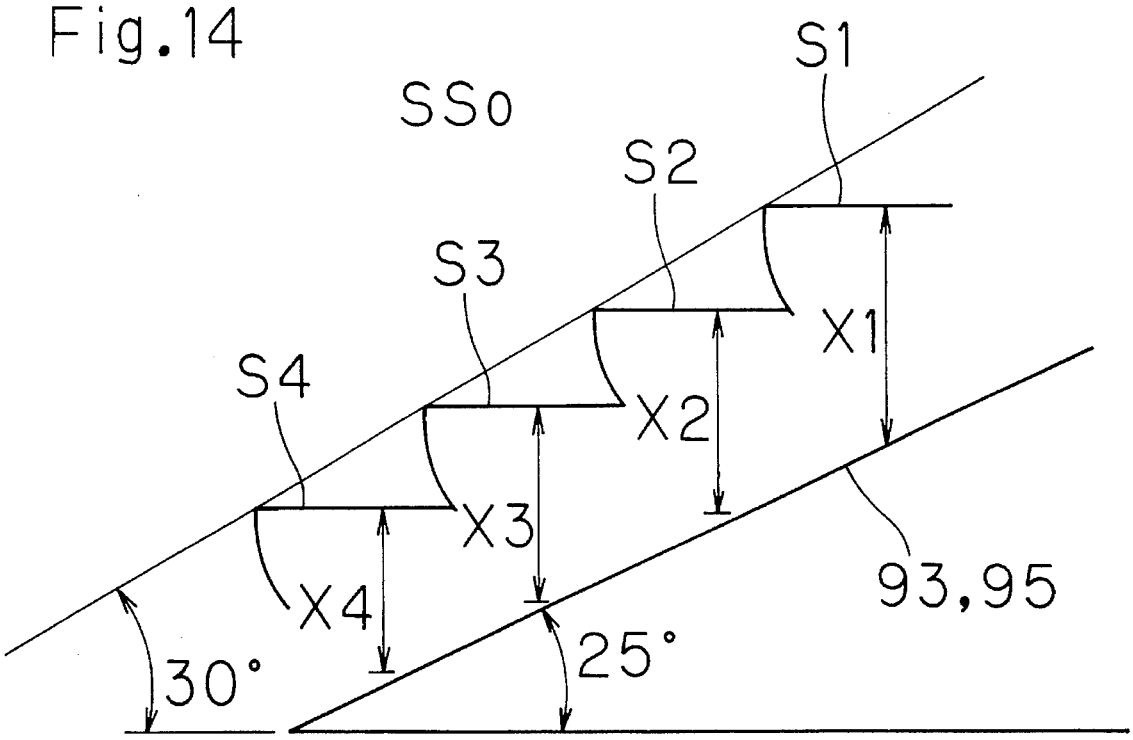
FIG. 14 is an explanatory view for explaining the positional relation of special steps for ordinary passengers in an inclined region.

That is, to move the group SS, composed of the special steps S1 through S9, in a direction, for example, inclined at 25°, the guide rails 93 and 95, which guide the steps, must also be inclined at 25°. However, since the special steps group $SS_0$ for ordinary passengers is disposed at an angle of inclination of 30° as shown in FIG. 14, the distances X1 through X9 between the step surfaces and the guide rails 93, 95 differ from each other, which means that the levels of the front wheels S1*a* through S9*a* and rear wheels S1*c* through S9*c* guided by the guide rails 93 and 95 must be changed for each step.

However, if the path extends to the horizontal portion, the individual step surfaces will no longer align with each other. Therefore, in the horizontal portion, other front wheels S1*b* through S9*b* and rear wheels S1*d* through S9*d* (the distances from the guide rails 94 and 96 are equal to each other) are guided by other guide rails 94 and 96, thereby solving the above problem and greatly reducing the number of guide rails and minimizing the escalator width.

Figure 15A:
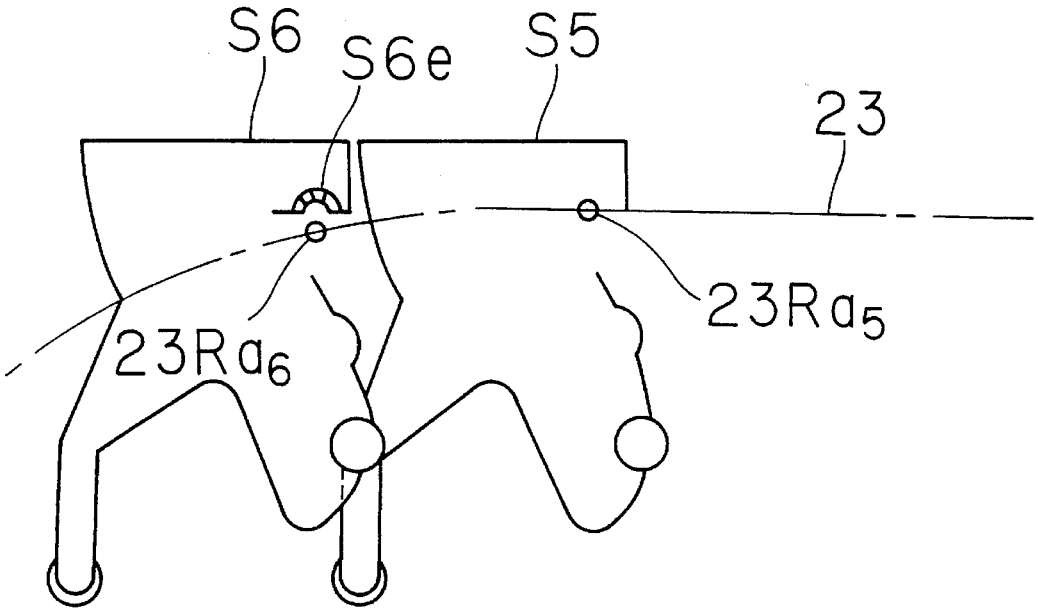
FIGS. 15(*a*)–15(*c*) are views showing the relation between special steps S1 through S9 and a step chain 23 according to the present invention.
Figure 15B:
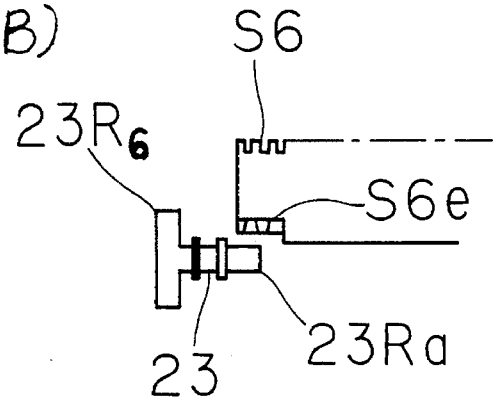
Figure 15C:
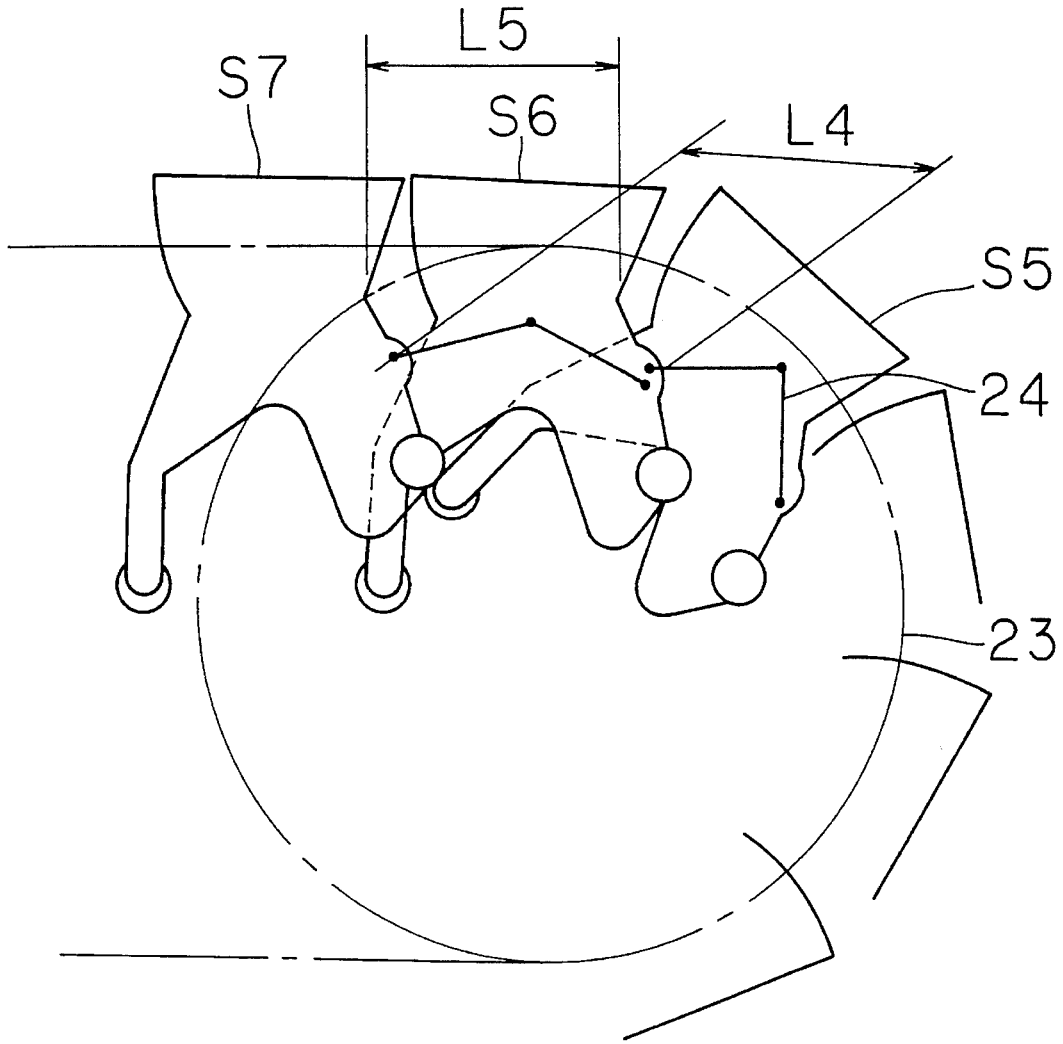

The numeral 23 denotes a step chain connecting the shaft STRa of the front wheel STa of each ordinary passenger step ST, the shaft 911*a* of the front wheel 911 of the specific step 91, and the pins 23Ra of the chain wheels 23R in endless form throughout the periphery of the escalator. The chain wheels 23R are rotatably mounted on the step chain 23 through the pins $23Ra_1$–$23Ra_9$ at locations corresponding to the special steps S1 through S9. The chain wheels 23R ($23R_1$ through $23Ra_9$) are supported and guided by the guide rail $ST_1$ in the transport region of the escalator. 0n the sides associated with the special steps S1 through S9, as shown in FIGS. 15(*a*)–(*c*), the horizontal portion and reversal point of the escalator are formed with recesses S1*e* through S9*e* adapted to receive the shafts $23Ra_1$ through $23Ra_9$ therein to allow smooth reversing of the special steps S1 through S9, as in the case of the usual escalator.

Figure 16A:
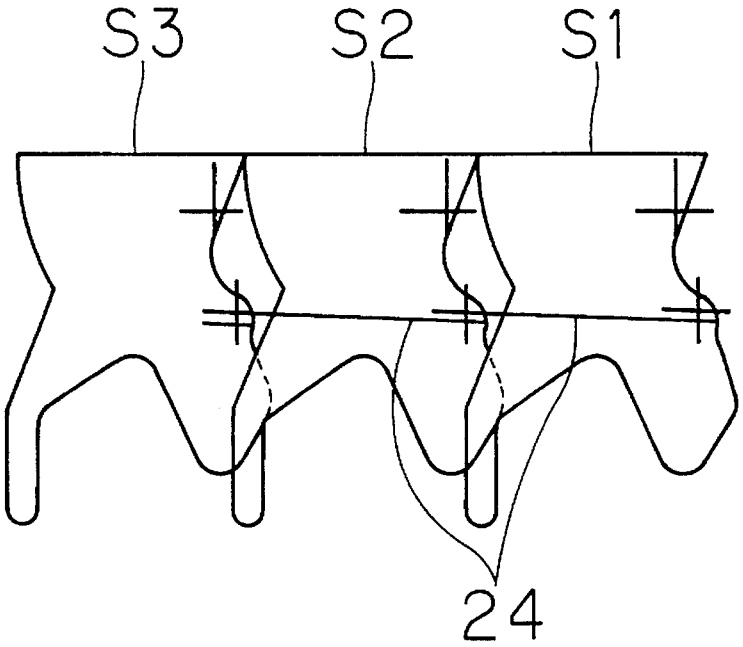
FIGS. 16(*a*)–(*b*) are views showing an embodiment for connecting and driving special steps S1 through S9 according to the present invention.
Figure 16B:
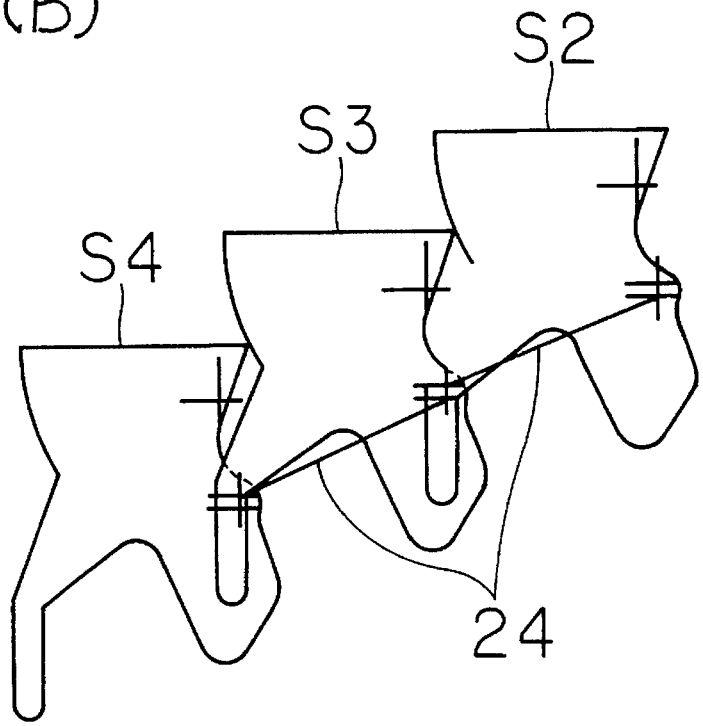

The numeral 24 denotes connecting links according to the present invention for connecting the special steps S1 through S9 in such a manner as to cause no problem in strength even if the rise of the escalator is increased. As shown in FIGS. 16(*a*) and 16(*b*), they are connected in the joint portions of the special steps S1 through S9 to form stepped portions and are bendable intermediate between the stepped portions.

Figure 17:
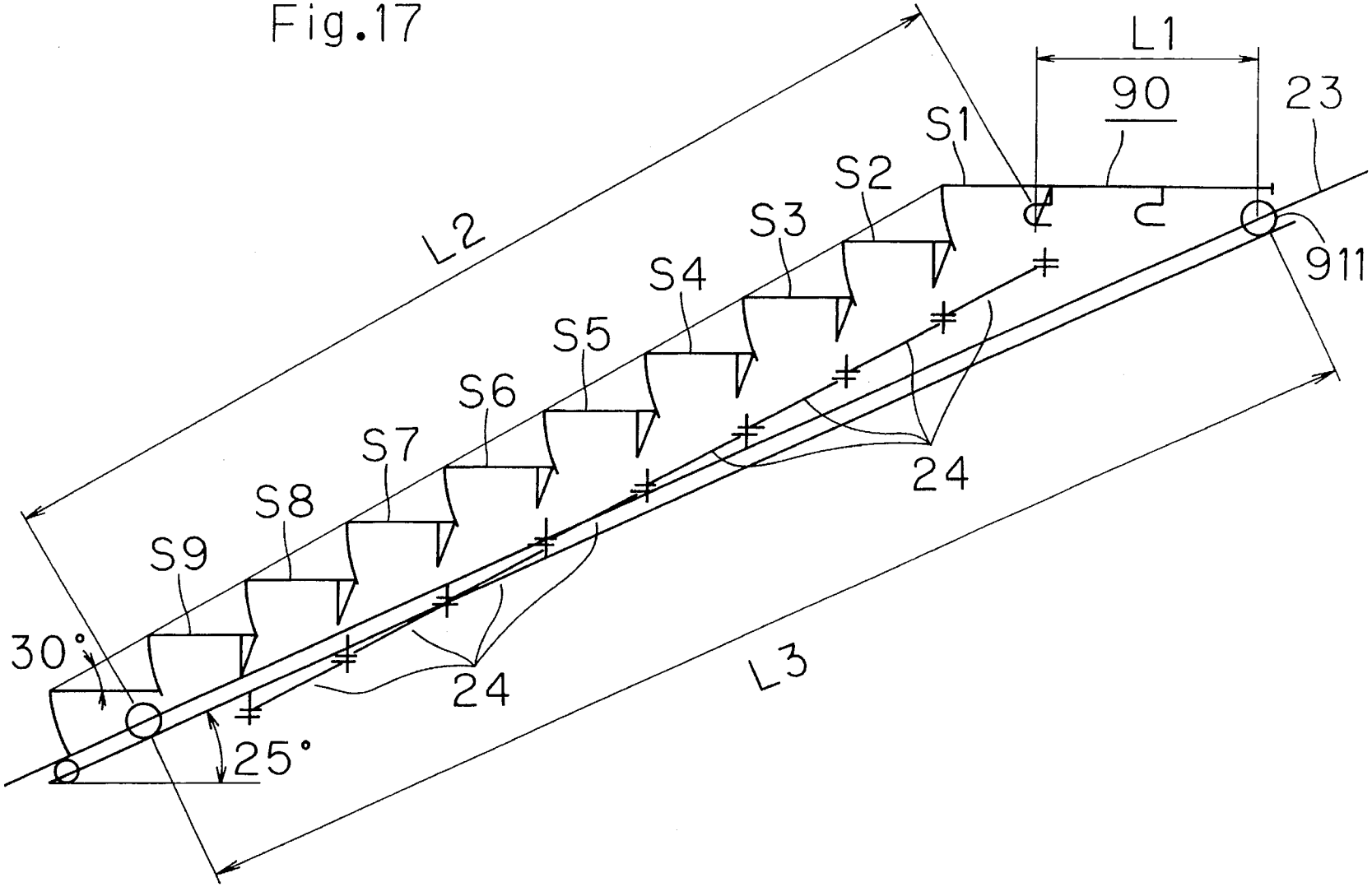
FIG. 17 is a view showing the disposition of connecting links 24 and step chains 23 for driving the large-sized step 90 and special steps S2 through S9 for ordinary passengers according to the present invention.

In the case of the escalator apparatus of such construction, the step chain 23 and the connecting links 24 have to be adjusted such that the dimensions L1, L2 and L3 shown in FIG. 17, satisfy the relation L1+L2>L3 in the inclined region and the relation L1+L2=L3 in the horizontal region. However, since the connecting links 24 are connected to form stepped portions, the state of FIG. 16(*a*) is established in the horizontal region, while the length is increased in the inclined region as shown in FIG. 16(*b*); therefore, the above arithmetic relations can be satisfied. Further, at the reversal point, as shown in FIG. 15(*c*), since each connecting link 24 is inwardly bent at the intermediate portion, the straight length L4 of the connecting links 24 becomes equal to the length L5 of the step chain 23, enabling smooth reversing of the special steps S1 through S9.

Figure 18:
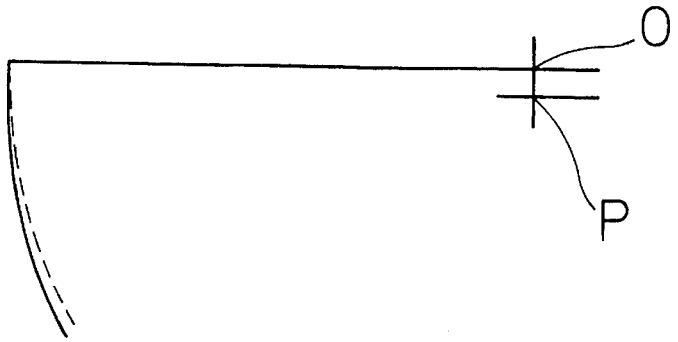
FIG. 18 is a view showing the shape of the riser surface for special steps S1 through S9.

As for the step chain 23, the above arithmetic relations are also satisfied by shaping the riser surface of each of the special steps S1 through S9 such that the center of the riser arc is displaced from the usual center O to a point P therebelow, as shown in FIG. 18.

Referring again to FIG. 1, the character PS1 denotes a vehicle operating button. When a passenger using a wheelchair or the like wants to use the escalator, he pushes this button PS1, whereby the large-sized step 90, when approaching the entrance area, is decelerated to make it easier for the person using the vehicle to step on. The character PS2 denotes a stepping-on confirmation button which, when pushed, gradually accelerates the escalator until the rated speed is reached. The character PS3 denotes a stepping-off confirmation button which, when pushed, restores a wheel stopping device to be later described.

In addition, such system using push buttons may be replaced by a different system in which wheelchair passengers carry transmitters with them to emit signals to decelerate or accelerate the escalator. As for such communications means utilized by wheelchair passengers, mention may be made of a wireless transmitter-receiver having an induction communications function for detection in a limited range.

If the escalator is operated with a vehicle mounted on this large-sized step 90, an accident of the vehicle falling off the large-sized step 90 will naturally be anticipated. To solve this problem, it is recommended to employ a wheel stopping device which is designed so that even when the escalator is moving, it can be automatically and smoothly projected and retracted. When a wheelchair, or the like, is not carried on the escalator, the wheel stopping device is housed so as not to project above the tread of the step.

Figure 19:
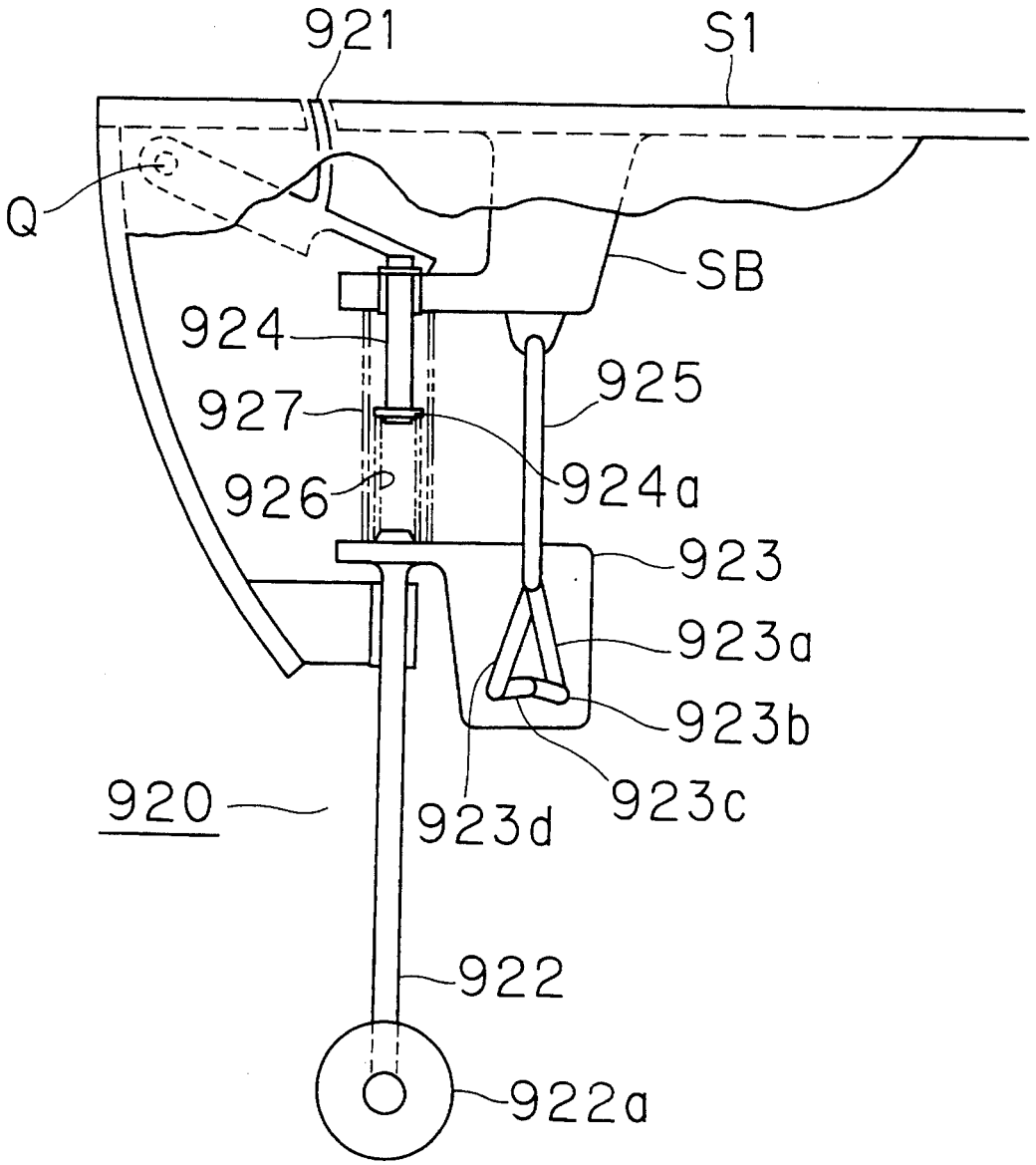
FIG. 19 is a complete view showing an embodiment of a wheel stopping device.

FIG. 19 is an enlarged view showing the mechanism of a wheel stopping device 920 installed in a special step S1 having a riser S1*r* among large-sized steps 90. In the figure, the numeral 921 denotes a wheel stop installed in the special step S1 so that it is turnable around a point Q, and 922 denotes a rod having a roller 922*a* at its lower end and a plate 923 at its upper end and adapted to be movable upward. And the plate 923 has grooves 923*a*, 923*b*, 923*c* and 923*d* cut therein in loop form as shown in FIG. 19 and having depth dimensions to be later described.

Figure 20:
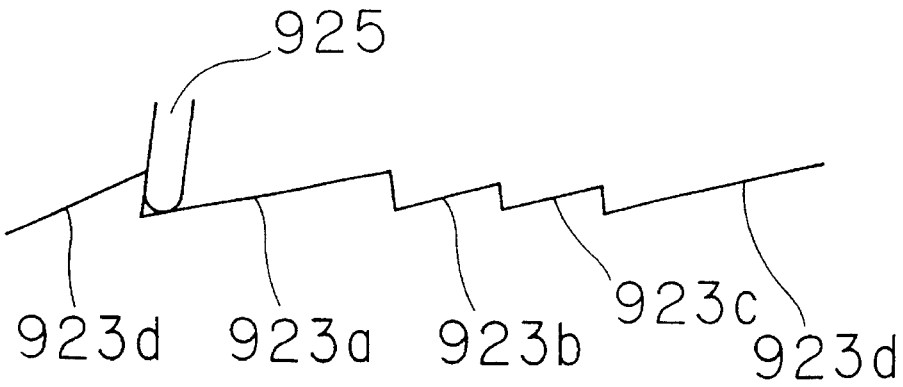
FIG. 20 is a view showing the shape of grooves 923*a* through 923*d* in a plate 923 in FIG. 19.

The numeral 924 denotes a rod installed for upward movement in a bracket SB on the special step S1. The rod is contacted at an upper end with part of the vehicle stop 921 to support the weight of the wheel stop 921. The rod has a washer 924*a* attached to its lower end. The numeral 925 denotes a lever rotatably supported at its upper end by the bracket SB on the special step S1. The lever 925 is guided at its lower end by the grooves 923*a*, 923*b*, 923*c* and 923*d* of the plate 923 in loop form in the order mentioned. More particularly, the grooves 923*a*, 923*b*, 923*c* and 923*d* of the plate 923 are machined such that, as shown in FIG. 20, each groove is deepest at its initial end, becoming gradually shallower until it reaches the deepest portion of the next groove. The arrangement turns the lower end of the lever 925 clockwise, but never reversed.

The numeral 926 denotes a spring interposed between the plate 923 and the washer 924*a*, and 927 denotes a spring interposed between the plate 923 and the bracket SB.

Figure 21:
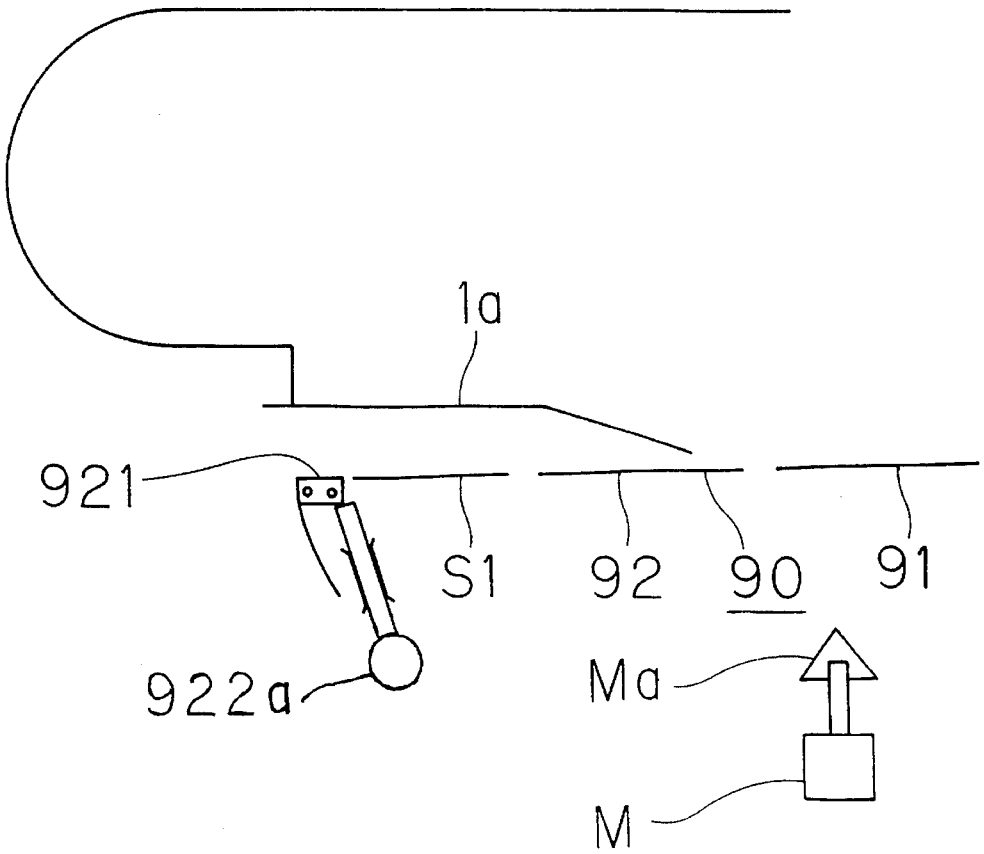
FIG. 21 is an explanatory view for explaining the operation of a wheel stop 921.

The operation of the present wheel stopping device 920 will now be described first with reference to the upward movement of the escalator. During the upward movement, a passenger in a wheelchair, or someone else, pushes the vehicle operating button PS1 (a portable transmitter may be employed) to rotate the motor M on an escalator body 1 shown in FIG. 21 to move a cam Ma upward.

The vehicle operating button PS1 is also operated to cause the large-sized step 90 to approach the floor plate 1*a* at the entrance area, whereupon the escalator is decelerated and the large-sized step 90 passes under the floor plate 1*a* while the roller 922*a* contacts the cam Ma, which pushes up the roller 922*a*.

Then, since the rod 922 is pushed up together with the plate 923 against the force of the spring 927, the lower end of the lever 925 lowers along the groove 923*a* (actually, the plate 923 rises) to enter the groove 923*b*. And when the roller 922*a* leaves the cam Ma in response to the movement of the special step S1, the force of the spring 927 moves the rod 922 backward or downward so the lower end of the lever 925 is guided by the groove 923*b* to enter the groove 923*c* where it is locked (assuming the state of being unable to move back). Therefore, when the special step S1 continues to move, no change in the position of the rod 922 and plate 923 relative to the special step S1 occurs.

Figure 22:
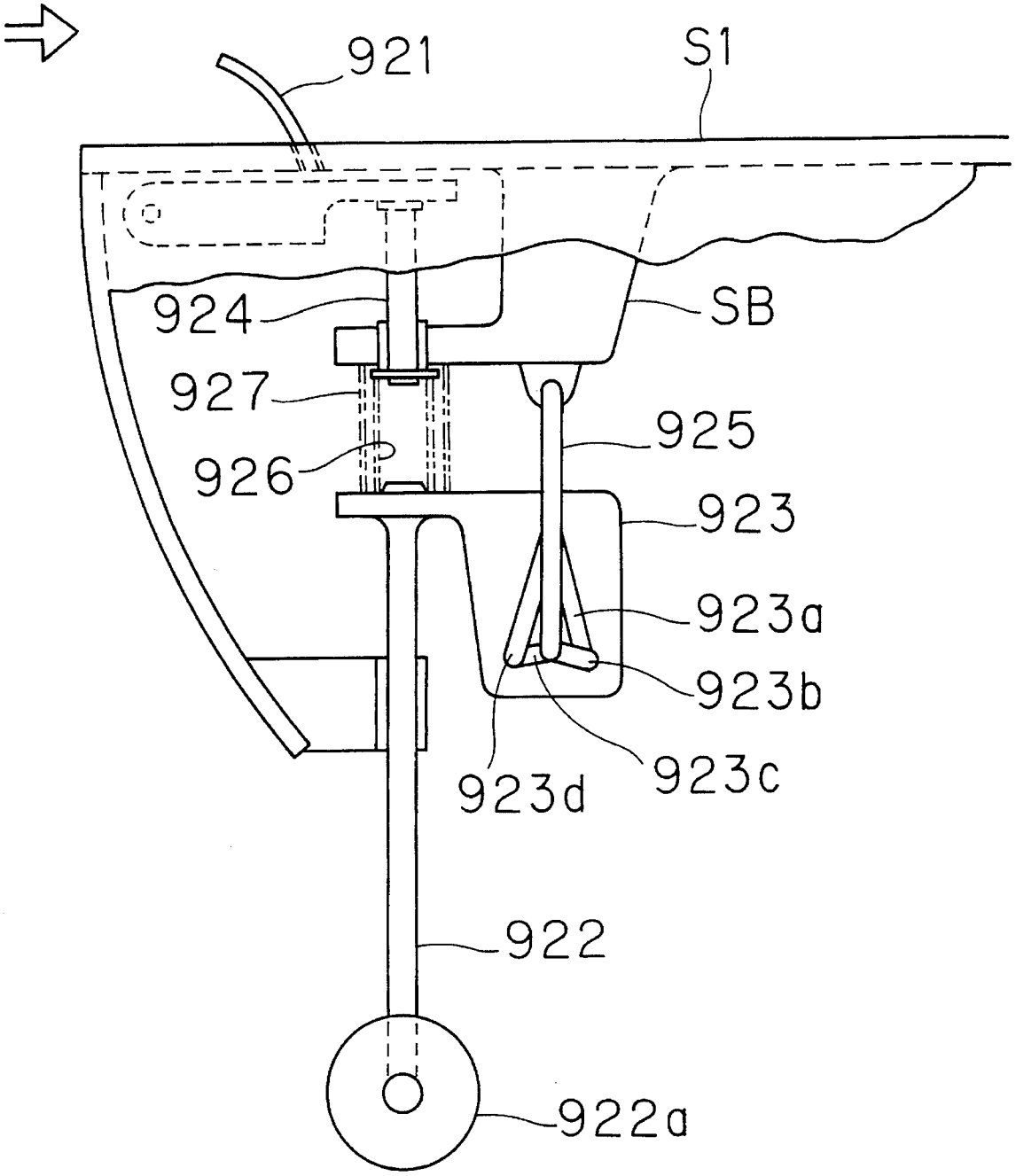
FIG. 22 is an explanatory view for explaining the operation of wheel stopping device 920.

When the rod 922 and plate 923 are pushed up, the force of the spring 926 also pushes up the rod 924 and hence the upper end of the rod 924 pushes up the wheel stop 921, with the result that the wheel stop 921 projects beyond the tread surface of the special step S1 as shown in FIG. 22.

When the wheel stop 921 is projected in this manner, a passenger, using a vehicle such as a wheelchair, steps on the special step S in the direction of arrow. If a force is applied to the wheel stop 921 in the direction of arrow, the spring 926 flexes so that the wheel stop 921 can be easily drawn into the tread. Therefore, there is no obstacle to moving onto the special step S, and once the passenger steps on, the wheel stop 921 projects again to prevent a vehicle from slipping off the special step S (even if a reverse force acts on the wheel stop 921, the latter will not move).

Figure 23:
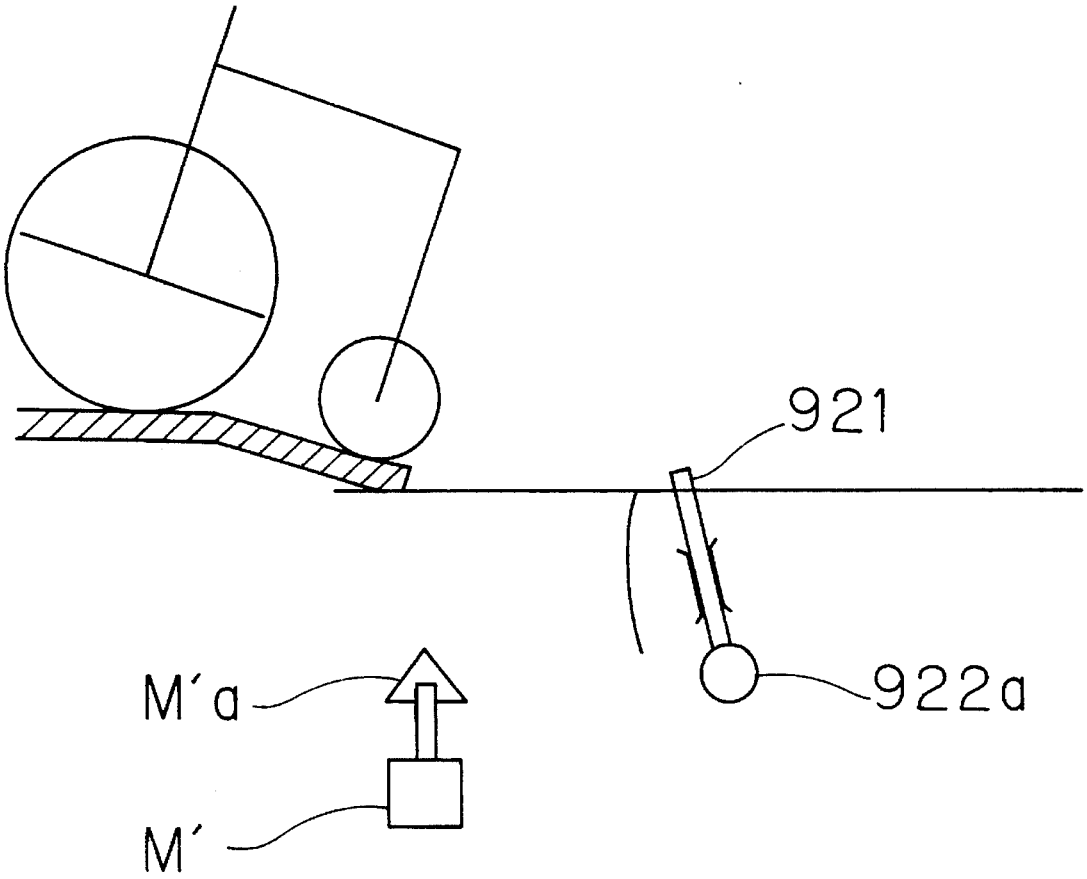
FIG. 23 is an explanatory view for explaining the operation of the wheel stop 921.

When the large-sized step 90 approaches the exit area, the roller 922*a* comes into contact with the cam M'a already moved upward by the motor M' shown in FIG. 23 (the time to drive the motor M' may be when the vehicle operating button PS1 or the stepping-on confirmation button PS2 is operated) and is thereby pushed up. Referring now to FIG. 22, the force of the cam M'a pushes up the rod 922 together with the plate 923 against the force of the spring 927, whereby the lower end of the lever 925 lowers along the groove 923*c* (actually, the plate 923 rises) to enter the groove 923*d*. As the special step S1 moves, the roller 922*a* leaves the cam M'a, whereupon the rod 922 returns to its lower position under the force of the spring 927, so that the lever 925 is moved with its lower end guided by the groove 923*d*, returning to the groove 923*a* to restore its original state where it is locked.

Since the rod 922 and plate 923 are lowered, the wheel stop 921 also lowers together with the rod 922 under its weight, restoring the state of the ordinary step in which it is completely received in the tread of the special step S1, as shown in FIG. 19.

During operation of the escalator, a passenger, using such a vehicle as a wheelchair, can step off the escalator at the exit area regardless of the state of the wheel stop 921. Therefore, there is no need to take the trouble of decelerating the escalator at the exit area.

After the passenger has stepped off, he pushes the stepping-off confirmation button PB3 to rotate the motors M and M' in the opposite direction to pull down the cams Ma and M'a so as to prevent interference between the roller 922*a* of the special step S1 and the cams Ma and M'a. Thus, during the lowering operation of the escalator there is no possibility of the wheel stop 921 projecting to form an obstacle which is liable to trip a passenger.

In addition, the lowering operation is almost the same as the lifting operation, and a detailed description of it is therefore omitted. The operation of the wheel stopping device 920 has much to do with the safety of the stepping-on and stepping-off of a vehicle. That is, during boarding, if the wheel stop 921 fails to be projected, the vehicle is liable to fall by inertia, or if the wheel stop 921 fails to be retracted, the vehicle cannot step off. Thus, it is desirable to run the escalator at low speed.

What is claimed is:

1. An escalator apparatus comprising:

a large-sized step assembly having special steps and a large-sized step with a greater depth than that of ordinary passenger steps;

guide means for guiding said large-sized step to maintain a top surface thereof in a horizontal state during travel through horizontal, transient and inclined regions of the escalator;

said guide means includes first and second sets of guide rails in the horizontal and inclined regions, respectively, for guiding said special steps;

said special steps having first and second means for engaging said first and second sets of guide rails respectively;

at least one of said special steps being disposed to form part of said large-sized step and remaining ones of said special steps extending to a lower portion of the large-sized steps assembly; and said large-sized step having a wheel stop mechanism for projecting a wheel stop from said large-sized step as the large-sized step comes out of a floor plate and for retracting the wheel stop as said large sized plate enters the floor plate.

2. An escalator apparatus having inclined, transient, and horizontal regions for passenger transport comprising:

a large-sized step assembly having special steps and a large-sized step with a greater depth than that of ordinary passenger steps;

guide means for guiding said large-sized step assembly to maintain tread surfaces thereof in a horizontal state during travel through the horizontal, transient and inclined regions of the escalator;

said guide means including first and second separate pairs of guide rails, in the inclined and horizontal regions respectively, for guiding said special steps during passenger bearing operation;

said special steps each having at least a first pair of wheels for engaging said first pair of guide rails in the inclined region and at least a second pair of wheels for engaging the second pair of rails in the horizontal regions; and said large-sized step including at least one of said special steps and said special steps extending successively from said large-sized step to a lower part of said large-sized step assembly.

3. The escalator apparatus according to claim 2 wherein said pair of wheels for the horizontal region consist of front wheels and rear wheels and said pair of wheels for the inclined region consist of front wheels and rear wheels respectively.

4. The escalator apparatus according to claim 2 wherein:

individual steps, of said special steps, are moved in a first transport mode in the inclined region where the first pair of wheels engage the first pair of guide rails;

said individual steps are moved in a second transport mode in the horizontal region where the second pair of wheels engage the second pair of guide rails; and said first and second pairs of guide rails are disposed proximate each other in the transient region of operation to permit a transfer of engagement between said first pair of wheels and guide rails and said second pair of wheels and guide rails by continued motion of said individual steps.

5. The escalator apparatus according to claim 2 wherein:

a first one of said special steps is higher than a second one of said special steps; and said first pair of wheels of said first one of said special steps is further from the tread surface thereof than said first pair of wheels of said second one of said special steps.

6. The escalator apparatus according to claim 5 wherein said second pair of wheels for transport in the horizontal region of one of said special steps is the same as that of another one of said special steps.

7. The escalator apparatus according to claim 2 wherein said second pair of wheels for transport in the horizontal region of one of said special steps is the same as that of another one of said special steps.

8. The escalator apparatus according to claim 2 wherein said first pair of wheels of each of said special steps are disposed differing distances from said tread surfaces thereof dependent upon location relative to said large-sized step with said first pair of wheels of an upper most one of said special steps being the furthest from said tread surface and said first pair of wheels of a lower most one of said special steps being the closest to said tread surface.

9. The escalator apparatus according to claim 2 wherein the second set of wheels of each of said special step is disposed equidistant from said tread surfaces.

10. An escalator apparatus having inclined, transient, and horizontal regions for passenger transport comprising:

an oversized step assembly having an oversized step suitable for accepting wheelchairs and similarly proportioned items;

said oversized step assembly having special steps successively arranged from a lower portion of said oversized step assembly to said oversized step at a top of said step assembly;

inclined rail means for carrying said oversized step assembly through said inclined region during transport of passengers;

said special steps each having a set of wheels for engaging said inclined rail means;

said inclined rail means defining a first angle with respect to a horizontal plane;

said special steps being successively arranged on a second angle of inclination greater than said first angle; and said special steps having tread surfaces and said sets of wheels disposed at differing distances from said tread surfaces of individual special steps to maintain said tread surfaces parallel to a horizontal plane.

11. The escalator apparatus of claim 10 further comprising:

second rail means for carrying said oversized step assembly through a horizontal region during transport of passengers; and said special steps each having a second set of wheels for engaging said second rail means to maintain said tread surfaces of said individual steps parallel to a horizontal plane.

* * * * *